US008887652B1

(12) United States Patent
Berte

(10) Patent No.: US 8,887,652 B1
(45) Date of Patent: Nov. 18, 2014

(54) SAIL PROPULSION DEVICE FOR CARGO AND TANKER VESSELS

(75) Inventor: Frank Joseph Berte, Westford, MA (US)

(73) Assignee: Innovative Marine Technology, Inc., Westford, MA (US)

( * ) Notice: Subject to any disclaimer, the term of this patent is extended or adjusted under 35 U.S.C. 154(b) by 30 days.

(21) Appl. No.: 13/604,596

(22) Filed: Sep. 5, 2012

(51) Int. Cl.
*B63B 35/00* (2006.01)
*B63B 15/00* (2006.01)

(52) U.S. Cl.
CPC ..... *B63B 15/0083* (2013.01)
USPC ..... 114/39.27

(58) Field of Classification Search
CPC ..... B63H 9/00; B63H 9/04; B63H 9/06; B63H 9/0607; B63H 9/0685; B63H 9/08
USPC ..... 114/39.21, 39.22, 39.26, 39.27, 39.28, 114/39.31, 39.32
See application file for complete search history.

(56) References Cited

U.S. PATENT DOCUMENTS

| | | | | | |
|---|---|---|---|---|---|
| 3,395,664 | A | * | 8/1968 | Greenberg et al. | 114/39.27 |
| 4,294,184 | A | * | 10/1981 | Heinrich | 114/61.16 |
| 4,326,475 | A | | 4/1982 | Berte | |
| 4,777,897 | A | * | 10/1988 | McKenna | 114/39.27 |
| 5,134,950 | A | | 8/1992 | Berte | |
| 5,894,807 | A | * | 4/1999 | Aiken | 114/39.11 |
| 8,695,520 | B1 | | 4/2014 | Berte | |

* cited by examiner

*Primary Examiner* — Daniel V Venne
(74) *Attorney, Agent, or Firm* — Nields, Lemack & Frame, LLC

(57) ABSTRACT

The sailing space frame of the present invention is supported by three hulls, a rudder hull a dagger board hull and an outrigger hull. The space frame also includes two mast assemblies, a fore spar, and a crew's quarters. The space frame can couple with a vessel propelled by a fossil fueled engine, and convert the combined space frame/vessel into an efficient sailing vessel that does not require fossil fuel for the trans-ocean portion of its voyage between ports. The outrigger provides sufficient stability to the sail propelled vessel so that it can carry a large enough sail area to supplant the use of the fossil fueled engine on the open ocean between ports. When entering or leaving a port the vessel uses its own engines for propulsion.

8 Claims, 20 Drawing Sheets

SECTION A–A

FIG. 45
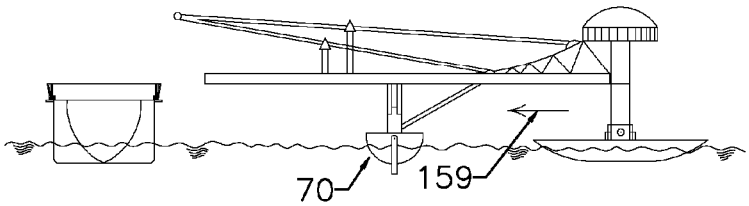
FIG. 46
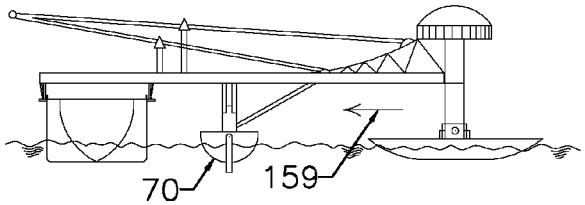
FIG. 47
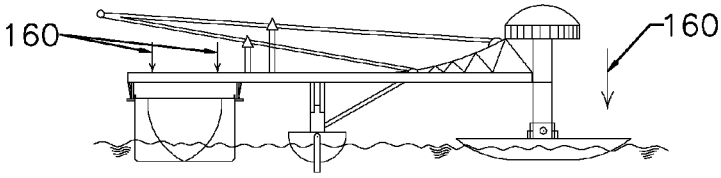
FIG. 48
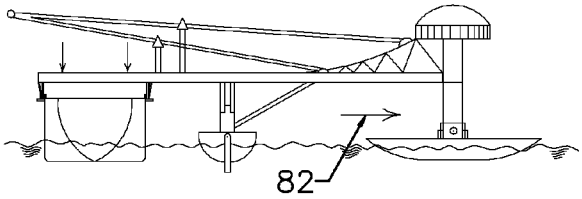
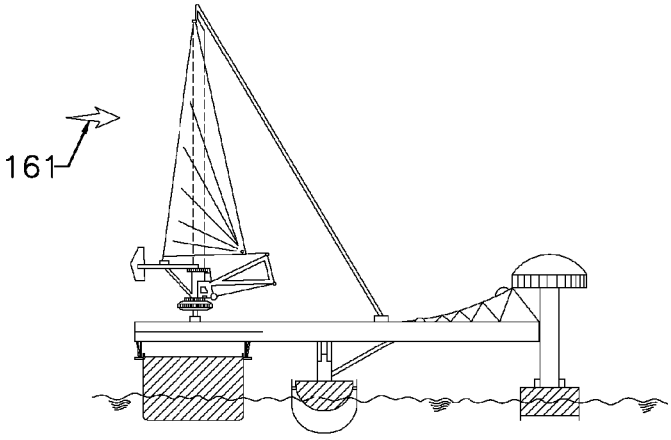
FIG. 49

SAIL PROPULSION DEVICE FOR CARGO AND TANKER VESSELS

STATEMENT REGARDING FEDERALLY SPONSORED RESEARCH OR DEVELOPMENT

The First Generation Improved Sailboat in the evolution of the present invention received the U.S. Pat. No. 4,326,475-awarded on Apr. 27, 1982. This patent application was supported by a National Science Foundation Grant to the Massachusetts Institute of Technology's Innovation Center. The MIT Innovation Center in turn used these funds to pursue the application for the first patent on this improved sailboat concept; this was the first prototype of this new generation.

TECHNICAL FIELD AND APPLICABILITY OF THE INVENTION

This invention relates to a sailing space frame that can be coupled and decoupled to/from cargo and tanker vessels in order to provide sail powered propulsion of these vessels on the trans-ocean portion of their voyage.

I claim priority this application based on my Provisional Patent Application No. 61/573,638, Filed on Sep. 9, 2011.

CROSS-REFERENCE TO RELATED APPLICATIONS

The present invention is the result of a sailboat design evolution starting from The First Generation Improved Sailboat This incorporated a tetrahedral space frame design with three identical hulls, one at each of the three vertices of the triangular deck, and a conventional main/jib sail configuration, see U.S. Pat. No. 4,326,475. The Second Generation Improved Sailboat continued the evolution process of the concept by the incorporation of two identical sails/mast assembly configurations which formed the two edges of the tetrahedral shape above the triangular deck, see U.S. Pat. No. 5,134,950. The Third Generation Improved Sailboat, patent pending, incorporated additional design features in sail design/rigging and vessel directional control. The present invention is a further evolution of some of these concepts into a sailing space frame that provides temporary sail powered propulsion for cargo and tanker vessels.

REFERENCE TO A SEQUENCE LISTING

Not Applicable

BRIEF SUMMARY OF THE INVENTION

The present invention relates to sailing space frame having three hulls. This concept was initially funded by the National Science Foundation through the MIT Innovation Center in the 1970's has been under development and testing for many years. Components of the first U.S. Pat. No. 4,326,475 for an improved sailboat, the second generation Improved Sailboat U.S. Pat. No. 5,134,950, and the third generation Improved Sailboat (which is a pending patent application) are all utilized in the present invention using an evolved configuration adapted for use to propel cargo or tanker vessels in the trans-ocean portion of their voyages. The sailing space frame is coupled or decoupled from the vessel to be propelled, when the vessel to be propelled is outside of the destination or origination port facilities, this is required so as not to impair the ability of the propelled vessel to maneuver in the port area. The present invention is basically a sailing space frame capable of propelling an engine powered vessel, over long distance routes between ports, under sail power. The combination of the sailing space frame and the vessel to be propelled turns the combination into a Proa configuration, where a Proa is a typically a small sailing canoe, having a sail, with an attached outrigger on one side primarily used in the past for ocean passages by islanders living in the Pacific Ocean. The outrigger allows the Proa to carry a sail area much larger than the canoe could carry without the outrigger. In the present invention the vessel to be propelled is like a large canoe, and the sailing space frame provides the outrigger, as well as the needed sails, rudder, and dagger board components needed to convert the coupled vessel into a viable sailing vessel. The large sail area provided by the current invention for the propelled vessel allows propulsion of the cargo or tanker vessel under sail power, without the need for operation of the vessel's engine for propulsion purposes. The use of the present invention will reduce the amounts of carbon dioxide that is typically generated by trans-ocean cargo and tanker ship's diesel engines; it will also save fuel, and reduce the need for ballast water in cargo ships and tanker vessels since the outrigger in the Proa design stabilizes the vessels in the open ocean. The use of the sailing space frame to propel cargo and tanker vessels will reduce the spreading of alien species that inhabit ballast water that is used to stabilize the vessels and which gets spread across the ocean in the cargo or tanker vessel ballast tanks. The present invention relates to sailing space frame having three hulls. One of these hulls is an outrigger hull; the other two hulls are used, both to support the space frame, as well as to provide the dagger assembly support and rudder assembly support structures respectively. The deck of the space frame has an approximately triangular configuration. This sailing space frame also incorporates two mast assemblies and a set of four identical sails. The two mast assemblies and a fore spar which are attached to the triangular deck of the present invention serve to support the mast assemblies, without the need for rigging. The space frame can sail independently on its three hulls to a desired location outside of a port area, and then remain at this location, sails furled, and the mast assemblies and fore spar folded down on top of the triangular deck of the present invention, until a tanker or cargo vessel; in need of sail powered propulsion gets close to the sailing space frame. At this point the space frame triangular deck is elevated by electric or hydraulic means to raise the deck structure above the deck of the vessel to be propelled. This is accomplished by moving the outrigger hull and the rudder and dagger board hulls down, relative to the space frame triangular deck structure, thus raising the space frame deck. The space frame is then propelled by electric driven thrusters in the outrigger hull and approaches the vessel (which is not under way) to be propelled, in a direction perpendicular to the length of the vessel. The rudder and dagger boards are rotated so as to be oriented in the direction of motion of the outrigger. Once the portion of the deck triangular structure is above the deck of the vessel to be propelled, the deck structure of the present invention is lowered until the sailing space frame rests on two bridges which are installed on the vessel to be propelled, while it is in port. The space frame is then mechanically coupled to the vessel. At this point the foot of each mast assembly and the foot of the fore spar are moved along the rails on the deck structure by their respective trolley translation mechanisms so that the mast assemblies are raised into the fully deployed sailing configuration of the present invention. At this point the outrigger hull is rotated so that it is now parallel to the length of the vessel to be propelled. Similarly the rudder and dagger boards are also rotated so as to be oriented for forward motion of the propelled vessel. Final adjustments are made mechanically on the elevation of the outrigger hull so that the deck of the propelled vessel and the sailing space frame deck are both horizontal. The rudder and dagger board hulls are then released from the mechanical elevation control and just float on the water, only supporting the weight of the respective rudder and dagger board assemblies. This insures that hydrodynamic drag forces of these components on the coupled vessel and the sailing space frame are reduced considerably. The rudder and dagger boards provide the coupled vessel the required leeward resistance as well as strong directional control so that the coupled vessel/sailing space frame can behave as a true sailing vessel capable of sailing on a broad reach, downwind, and a close reach, and thus take advantage of the wind for propulsion, no matter in which direction it comes from relative to the intended course of the coupled vessel.

STATEMENT OF THE OBJECTIVES OF THE INVENTION

The object of the present invention is to utilize some of the evolutionary improvements developed in the previously mentioned granted and pending U.S. patents on improved sailboat design for addressing the problem of reducing the use of fossil fuels for the propulsion of tanker and cargo vessels.

A still further objective is to convert the diesel powered vessel to be propelled by the present invention into an efficient sailing vessel for the trans-ocean portion of the vessels voyage.

A still further objective is to utilize wind, wave and solar energy sources to power the operation and control functions of the present invention, both when it is decoupled, and also when coupled, to the vessel to be propelled.

A still further objective is to allow the vessel to be propelled to enter and exit ports of call, unencumbered by the present invention.

A still further objective is to reduce the need for ballast water in vessels being propelled by the present invention.

A still further objective is to temporarily convert diesel powered vessels into sail powered vessels for the major portion of their trans-ocean voyage.

A still further objective is to be able to sail in wide range of wind velocity conditions without requiring reefing.

A still further objective is to insure that coupling of the present invention to a vessel will allow the propelled vessel to be capable of sailing downstream, or on a broad reach, as well as to perform tacking maneuvers similar to the capabilities of typical sailboats, thereby utilizing the wind from all quarters for propulsion.

A still further objective is to insure that the rudder and dagger boards attached to their respective support hulls can be used to provide the required leeward resistance for the coupled vessel under sail.

A still further objective is to insure that the sails of the present invention can weathervane without any rotational constraint, unless oriented relative to the apparent wind for thrust by the winglets, or by the relative positioning of the two sails in each sail set.

A still further objective is to insure that both the dagger board and rudder board orientations can be controlled in coordination to improve the steer-ability of the vessel coupled to the present invention.

A still further objective is to utilize the outrigger hull of the present invention to ride over waves and in the process generate electricity for propulsion and control purposes.

A still further objective is to provide a horizontal area on the roof of the crew's quarters, above the outrigger support structure on which solar cells can be mounted in order to provide additional electric generation for the present inventions propulsion and control purposes.

A still further objective is to insure that the power of the wind is utilized to assist in mast assembly assemblies orientation changes without requiring mechanisms (such as block and tackle) to offset wind loads.

A still further objective is to insure that in downwind sailing the foot of each mast assembly and the fore spar can be moved along the triangular base structure to allow all sails on the present invention, when coupled to a vessel to be propelled, to "see" clear air.

A still further objective is to insure that the electrical motor driven propellers that provides outrigger thrust can be used for both auxiliary propulsion of the present invention when not coupled to a vessel, as well to provide thrust needed to rotate the outrigger relative to the triangular base structure when needed, and finally to provide thrust to assist in tacking maneuvers in light wind conditions for the vessel to be propelled by the present invention.

A still further objective is to insure that the rudder and dagger board hull support structures of the present invention are configured to both raise and lower the triangular base structure of the present invention during coupling or uncoupling to a vessel to be propelled, as well as, to just support the weight rudder and dagger boards without incurring excessive hydrodynamic drag forces.

A still further objective is to utilize the dagger and rudder board to limit drift when the present invention is not under sail.

A still further objective is to insure that the dagger board and rudder always remain in the water independent of wave action.

Other objectives are evident in the description that follows. The foregoing objectives are achieved generally in the present invention that includes a space frame, having an outrigger hull, sails which can oriented to the apparent wind or allowed to weathervane, a rudder board and a dagger board hull, both of which can be rotated relative the space frame for sailing configuration control when coupled or uncoupled to a vessel to be propelled, and crew's quarters with a solar cell covered roof area called the solar dome.

BRIEF DESCRIPTION OF THE SEVERAL VIEWS OF THE DRAWING

The invention is hereafter described with reference to the accompanying drawings in which;

FIG. 45 is a side view of the sailing space frame of the present invention moving toward the vessel to be propelled, with the two mast assemblies and the fore spar in the pre-deployed configuration;

FIG. 46 is a side view of the space frame of the present invention when it is elevated above the vessel to be propelled, with the two mast assemblies and the fore spar in the pre-deployed configuration;

FIG. 47 is a side view of the sailing space frame of the present invention when the space frame is being lowered onto the bridges mounted to the vessel to be propelled.

FIG. 48 is a side view of the sailing space frame of the present invention when it is being coupled to the vessel to be propelled, with the two mast assemblies and the fore spar in the pre-deployed configuration;

FIG. 49 is an end view of the sailing space frame of the present invention coupled to the vessel to be propelled, with the two mast assemblies, the fore spar, and the sails in the fully deployed configurations, and the outrigger, and rudder assembly and dagger board assembly rotated to be parallel to the length of the vessel.

DETAILED DESCRIPTION OF THE INVENTION

The present invention is based on the aforementioned patented and patent pending sailboat design evolutions, each of which has utilized a space frame having a triangular base, with three hulls at the vertices of this triangle. In this present invention this design has been modified and adapted to the propulsion of cargo and tanker vessels. Because of the mechanical complexity of the design, the descriptions will be focused on the major elements of the present invention, and then this will be followed by description of the use, operation, as well as the improvements and innovations associated with the present invention in its entirety.

Figure 1:
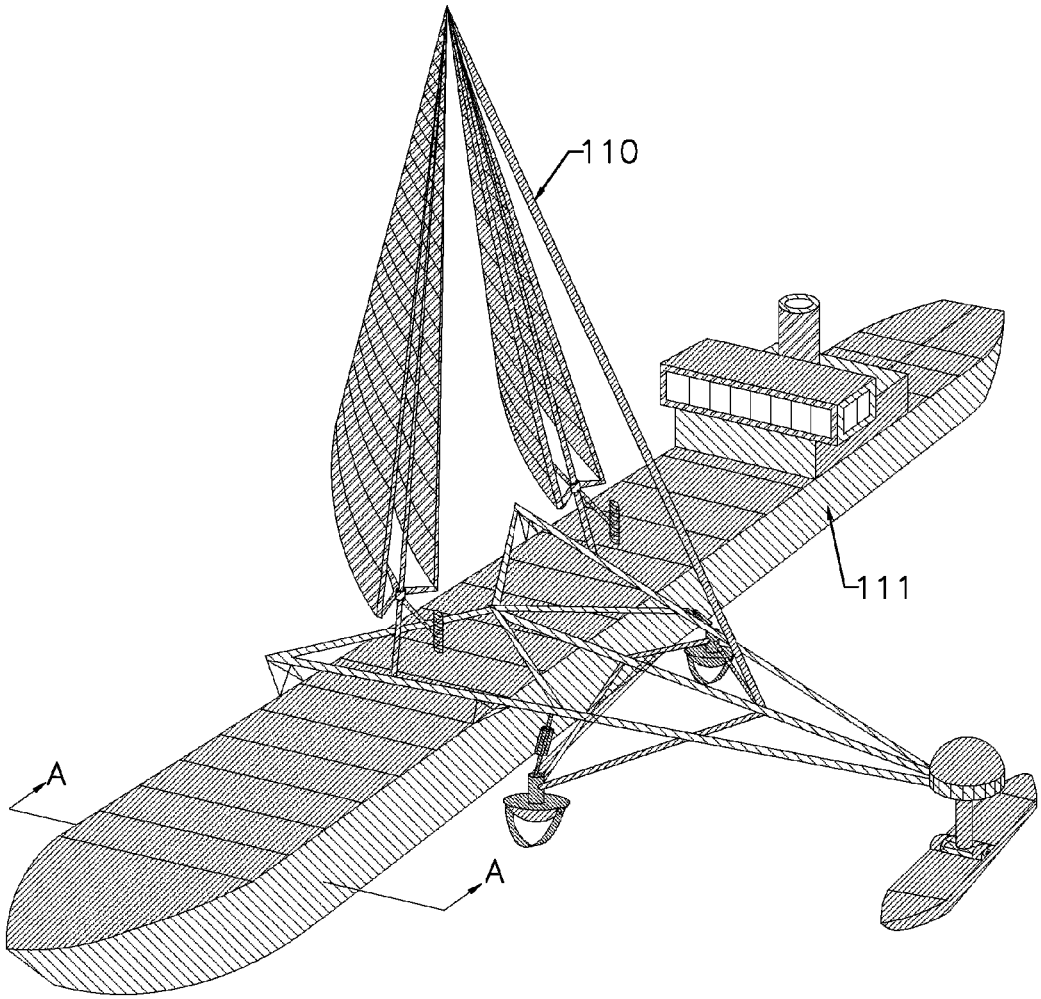
FIG. 1 is an isometric view of the sailing space frame of the present invention, sailing on a broad reach, coupled to a vessel being propelled.

Referring now to the drawings in greater detail, FIG. 1 illustrates the sailing space frame of the present invention 110, coupled to a vessel being propelled 111 on a broad reach, sailing downwind.

Figure 2:
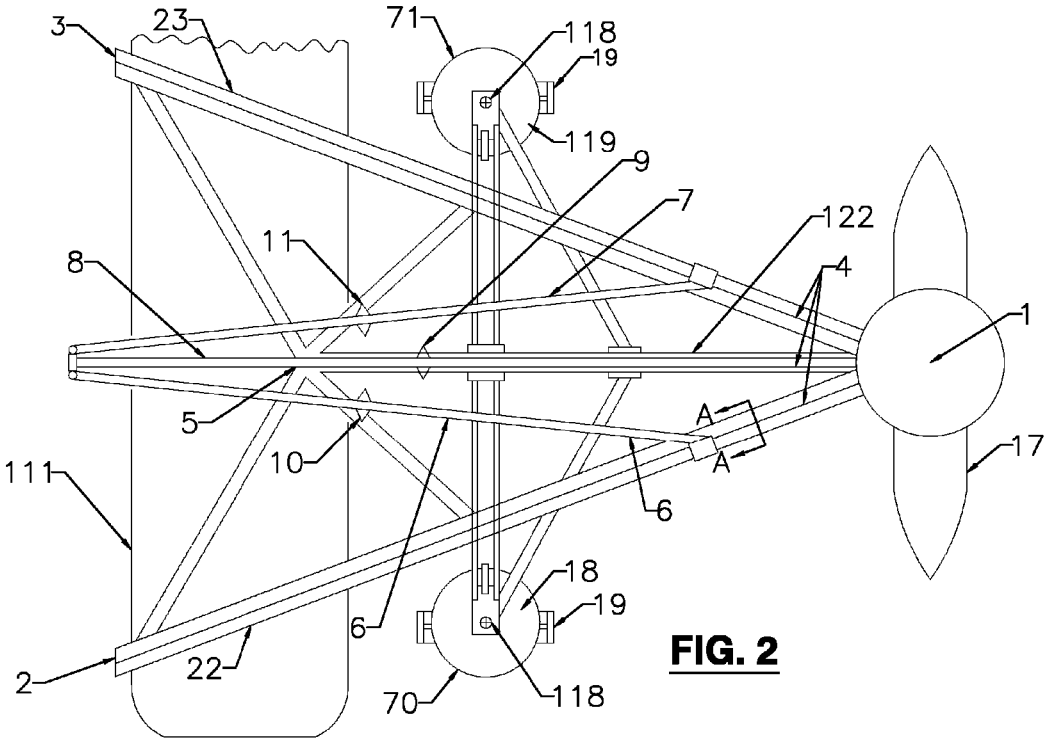
FIG. 2 is a plan view of the sailing space frame of the present invention, with the mast assemblies and the fore spar in the pre-deployed configuration, coupled to a vessel to be propelled.

FIG. 2 Illustrates a plan view of the sailing space frame of the present invention, with the mast assemblies and the fore spar in the pre-deployed configuration, coupled to a vessel to be propelled 111, which has an approximately triangular base of space frame 5, where the outrigger vertex 1 of the triangle is located directly over the outrigger hull 17. Also shown are the other two vertexes 2 and 3, of the triangular base of space frame 5, which are fixed to hull of the vessel to be propelled by sail power, where the sailing space frame is in the pre-deployed configuration. There are three primary beams that are part of the triangular base of space frame 5, an aft deck beam 22 which is coupled to the aft section of the vessel 111 to be propelled, a fore deck beam 23 which is coupled to the forward section of the vessel to be propelled, and the central deck beam 122. The space frame has a triangular deck; this is required so that the outrigger is coupled to the space frame at a single connection point (vertex 1). This configuration reduces bending loads on the space frame which has only three points of support when coupled to a vessel to be propelled, where two of these points are the bridges used for coupling to the vessel to be propelled, and the third is the outrigger—as explained shortly. This is in marked contrast to a typical Proa design, where there are two parallel beams, which connect the canoe to the outrigger. In this latter configuration, bending loads are generated when the forward section of the outrigger encounters a wave, which lifts the fore end of the outrigger relative to the aft end of the outrigger. This type of bending loads stresses the connecting beams as well as the hull of the canoe. In order to avoid these types of bending loads the triangular deck configuration was chosen for the present invention.

Figure 3:
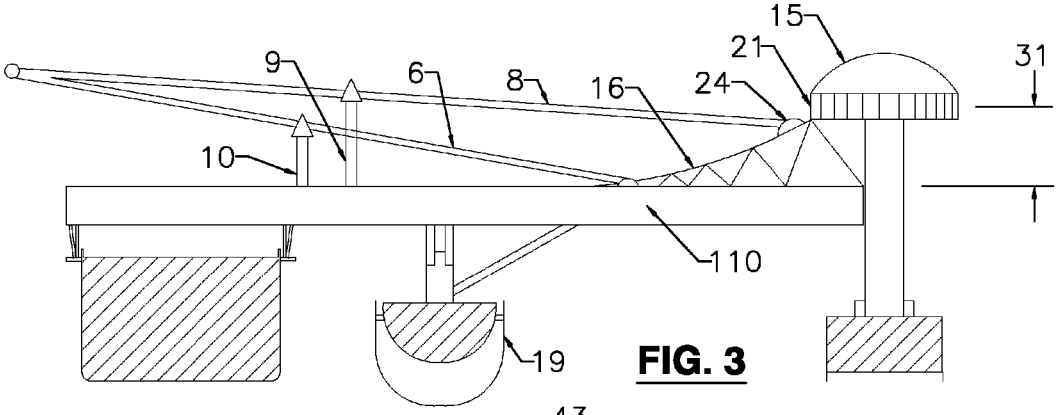
FIG. 3 is end view of the sailing space frame of the present invention with the mast assemblies and the fore spar in the pre-deployed configuration, coupled to a vessel to be propelled.

FIG. 3 illustrates and end view of the space frame 5 of the present invention, with the mast assemblies and the fore spar in the pre-deployed configuration, coupled to a vessel 111 to be propelled. There are three saddles 10, 11 (hidden in this view), and 9, which are attached to the space frame 5, which hold up the two mast assembly assemblies 6, 7, and the fore spar 8 as shown.

Figure 4:
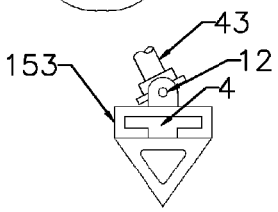
FIG. 4 is a sectional view of typical rail support beam for the foot of each mast assembly and the fore spar of the present invention.

FIG. 4, is a view of Section AA, in FIG. 2, of typical rail support beam for the foot of each mast assembly and the fore spar of the present invention which is a cross section of the beam, between vertex 1 and vertex 2, supporting the mast core 43 of mast assembly 6 on the rail 4 as shown in FIG. 2, mounted on it, and the trolley 153 mounted on it, along with the universal joint 12, which allows pivoting of the mast assembly core 43 and also free rotation of the mast assembly core 43, to be discussed later. This sectional view is also typical of the mast assembly core 43 attachments to its support beam between vertex 1 and 3, and on the fore spar 8, as shown in FIG. 2, and FIG. 3, except that the fore spar 8, in FIG. 3, cannot rotate about its cylindrical axis. The trolley 153 and 154 respectively at the base of each mast assemblies 6 and 7 and also the fore spar 8, is moved by electromechanical means along the respective rail to which it is attached, these devices are not shown. Each mast assembly trolley 153 and 154 and the fore spar trolley 24 can move along the entire length of its respective rail 4. When these trolleys are not being moved they are locked in place on their rail 4 according to the requirements for operation of the space frame 5 as discussed later.

Figure 5:
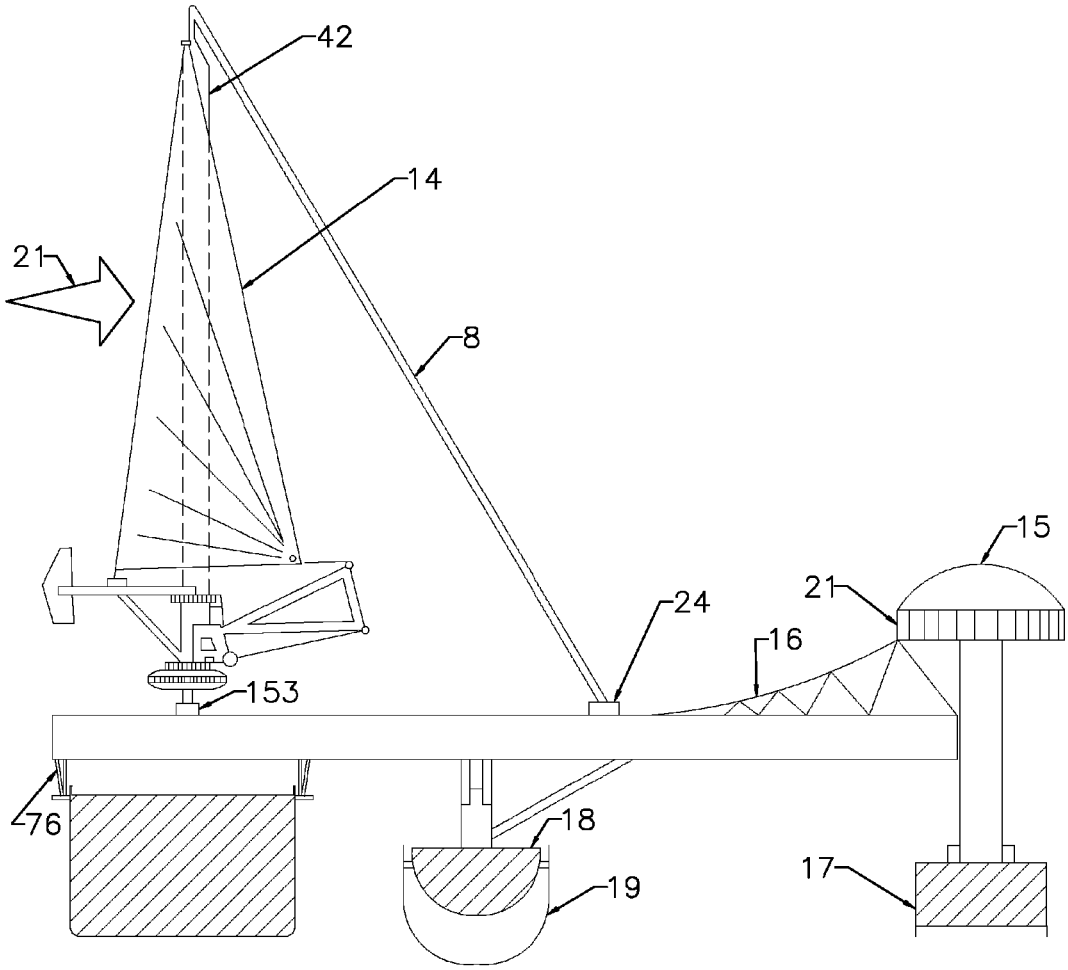
FIG. 5 is an end view of sailing space frame of the present invention coupled to a vessel to be propelled with the two mast assemblies and the fore spar in the fully deployed configuration.

FIG. 5 is an end view of the space frame 5 of the present invention, coupled to a vessel 111 to be propelled with the two mast assemblies and the fore spar in the fully deployed configuration and illustrates section AA in FIG. 1, The twin sail set 14 (also called alternatively the sail set in the following descriptions) on the mast assembly 6 closest to the stern of the vessel are shown in the fully deployed configuration and in the weather vane configuration, where the wind 21 is coming from the port side of the vessel 111. Only the stern most sail of the sail set 14 on this mast assembly 6 is shown since it blocks the view of the second sail of the said set 14 on the same mast assembly 6 as well as the mast assembly 7. The elevated section 16 of the rail 4 on which the fore spar trolley 24 moves is shown in FIG. 3. Also show in FIG. 5 is the solar dome 15 above the crew's quarters 21. These quarters are used by the crew of the present invention, when it is not coupled to the vessel to be propelled. In the following discussion, the term "board", as mentioned earlier for example in the terms rudder "board" and dagger "board", is now replaced by the more description term "semi ring wing foil". The outrigger hull 17 is shown in cross section in FIG. 5. The rudder assembly 18 is shown in cross section and the rudder semi ring wing foil 19 is shown also in cross section in FIG. 5. Finally, the stern most bridge on the vessel hull 76 is also shown in FIG. 5. The functions of these components will be discussed later. The mast assembly and sails components of the sailing space frame 5 are configured in an approximate tetrahedral configuration when fully deployed, as shown in FIG. 1. The foot of each mast assembly 6 and 7 is fixed via the typical universal joint 12 fixed to the associated trolley 153 as shown in FIG. 4. This trolley 153 rides on its respective rail 4 on the triangular base beams 22 and 23 in FIG. 2 of the space frame 5. The fore spar 8 foot is also fixed to a universal joint to a trolley which rides on a rail as also shown in FIG. 4. The rail 4 associated with the fore spar 8 is raised on a ramp 16 above the base plane of the triangular base of space frame 5 near the crew's quarters 21 adjacent to the solar dome 15 of the sailing space frame 5 as shown in FIG. 3. When the superstructure components i.e., the mast assembly assemblies 6 and 7 and fore spar 8 are to be deployed, the foot of the fore spar is higher 31 than the foot of each mast assembly 6 and 7 (which is hidden), as shown in FIG. 3, because it is located on the elevated track section 16 near the crew's quarters 21. This is required so that when the foot of each mast assembly is moved along its respective rail 4 on the two deck beams 22 and 23 toward the cargo ship, the lever arm distance 31 provided by the raised foot of the fore spar allows the elevation of the mast assembly 6 and 7 and fore spar 8 super structure to be made with less energy requirements. Each mast assembly core foot trolley 153 and 154 is driven also its rail 4 by an electric motor through a trolley translation mechanism (not shown). Before deployment of the mast assemblies and the fore spar these elements lie just above the top surface of the base triangle 5, as shown in FIG. 3. The fore spar trolley translation mechanism (not shown), working with the two said mast assemblies' trolley translation mechanisms (not shown) provide the means for the transition to and from the deployed and pre-deployed configurations of the mast assemblies and the fore spar. These components can be used to fold down said mast assemblies and said fore spar until they are in the pre-deployed configuration above said the triangular base of space frame 5 reducing the wind load on said space frame when it is not under way, or in storm conditions. Each mast assembly core 43 has bearings, not shown, which allows rotation of the mast assembly core 43 at the associated universal joint at the head and the foot of the mast assembly core so that each mast assembly core 43 and the aero foil 42 attached to it, can rotate freely about their respective mast core cylindrical axis 58 in FIG. 7. The aero foil can be rotated about the mast assembly core also and there are bearings, (not shown), between the mast assembly core and the aero foil along the length of the mast assembly core. Since the foot of each mast assembly and the foot of the fore spar are connected to their respective trolleys, these feet can be moved both in the folding process, as well as in the sailing mode, to assure that both sails of the sail set can see clean air even while sailing downwind—see motion 32 (away from nominal deployed configuration of this mast assembly core foot) of mast assembly 7 in FIG. 36.

Figure 6:
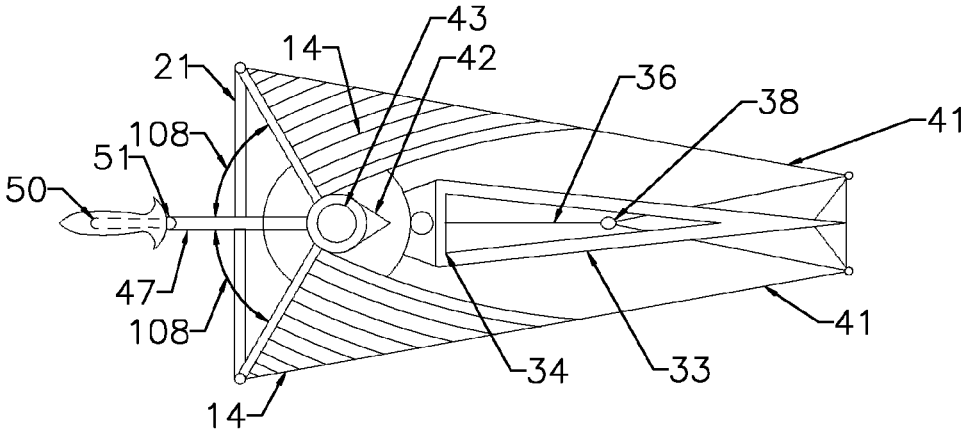
FIG. 6 is a top view of one of two identical mast assemblies, of the present invention, with sail set shown in the weather-vane configuration.

FIG. 6 illustrates a top view of one of the two identical mast assembly assemblies 6 and 7 of the present invention with sail set 14 shown in the weathervane configuration, where each mast assembly has a boom 33 fixed to the mast assembly core 43 through a hinge joint 34, on the boom base 174, which is fixed to the mast core 43. This hinge 34 allows the boom to be folded up against the mast assembly aero foil 42 as the sails of the sail set are furled as shown in 33, in Detail 112, in FIG. 8A. This folding process is required when it is desired to lower the superstructure into the pre-deployed configuration FIG. 3, or when the sails are desired to be depowered.

Figures 7, 8A:
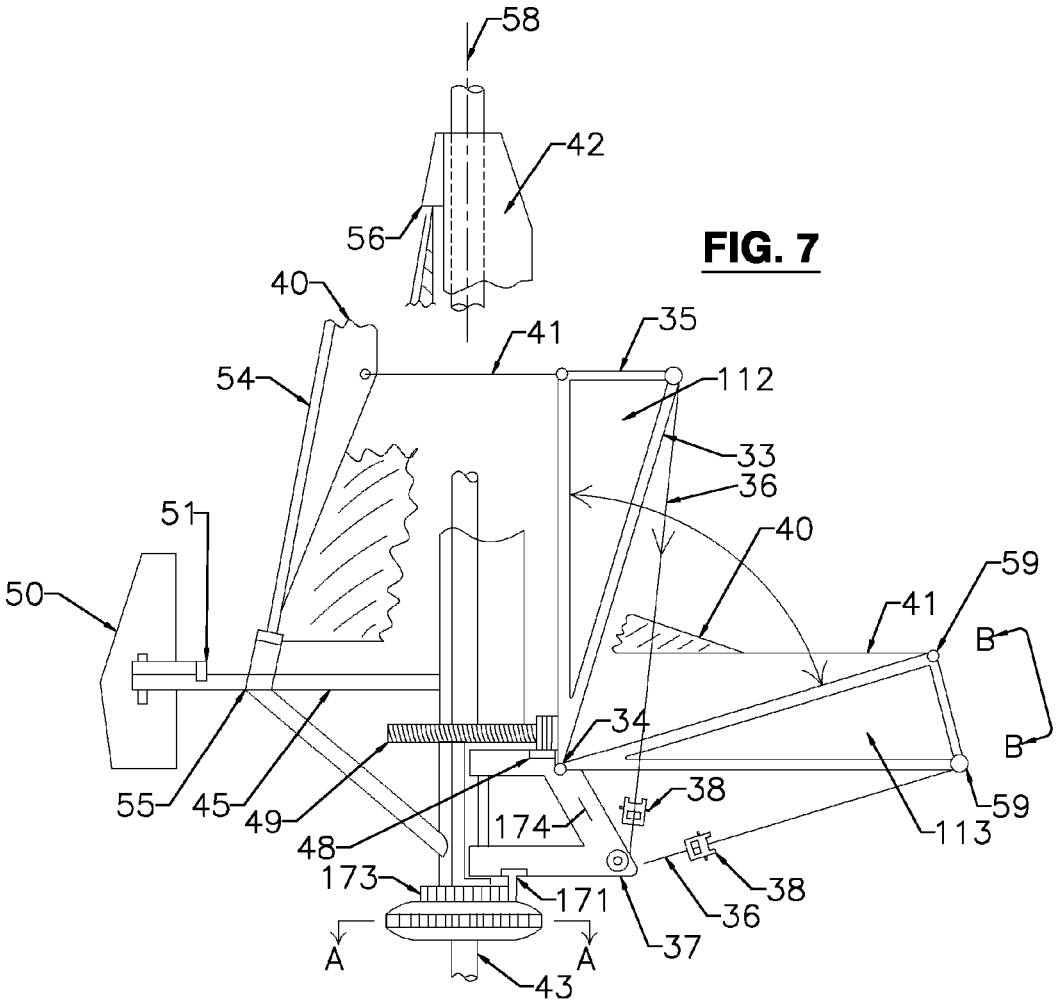
FIG. 7 is a side view of one of two identical mast assemblies' head of the present invention, showing the head of the sail set connection to the mast assembly head and the top of the aero foil section of the mast assemblies.
FIG. 8A is a side view of one of two identical mast assemblies' foot of the present invention, with a furled and unfurled sail configurations shown.

FIG. 7 is a side view of top section of the aero foil of the present invention the one of two identical mast assemblies' 6 and 7, which shows the upper swivel coupling of the roller furler 56 for one of the sails of the sail set at this location (the other swivel coupling is not shown), where the head of each of the two sails that form the sail set 14 are attached, and where the aero foil 42 can be rotated around the mast assembly core 43 as shown in FIGS. 11, 12, 13, and 14 configurations, moving the sail sets 14 around the mast core 43, to which the boom 33 is fixed.

FIG. 8A is a side view of the lower section of a typical mast assembly with details of foot of the mast assembly of the present invention, with a furled sail configuration with the boom 33 in position 112, and also with the boom 33 in the unfurled configuration 113. At the end of the boom where the jib sheet lines (from the sail set clews lines 41 in FIG. 6) are located, there are sheaves 59 which guide the these two lines 41 around the boom to the sheave 38. These sheaves 59 are capable of pivoting so as to line up with the loads imparted by the lines 41, as the aero foil 42 is rotated about the mast assembly core. The boom 33 has a boom yang cable 36 which is used to pull the boom down from its folded configuration 112 against the aero foil 42 into it fully deployed configuration, perpendicular to the mast core and aero foil cylindrical axis 58 see FIG. 7. The lower end of the boom yang cable 36 is attached to the foot of the mast assembly core through a winch 37 on boom base 174 as shown in FIG. 8A. At the upper end the boom yang cable 36 has a sheave 38 through which the (jib sheet) line 41 which connects each sail set clews on the individual mast assembly passes see 41 in FIG. 6. This boom yang cable is thus used to pull down the boom through the two lines both labeled 41 from the pre deployed configuration, as the sail set 14 are unfurled via this winch 37. When the boom 33 is fully deployed and the sails fully unfurled, the winch 37 on the bottom of the boom yang cable 36 is used to adjust the tension on the sail clews. An aero foil 42 cylinder surrounds each mast assembly core 43 and has bearings inside it that allow it to rotate freely around the mast assembly core 43. This aero foil section is rotated about the mast assembly core 43 by an aero foil rotation servo 48 rotating the gear 49 on the base of the aero foil 42 as shown in FIG. 8A. The aero foil servo 48 and the gear 49 at the base of the aero foil 42 provide the means controlling the orientation of aero foil 42 rotation relative to the mast core 43. A short distance above the location of boom hinge 34, on the aero foil 42 there are located two sail arms 45 and 46 (hidden) and a strut 47 holding a canard winglet 50, which is used to provide fine tuning of rotation of the mast assembly 6 (and similarly on 7) about the mast assembly core 43 cylindrical axis 58 when the sail set 14 are fully deployed. Thus when the canard winglet and the aero foil are in their weathervane configuration FIG. 6, the mast assembly rotates about its mast core cylindrical axis 58 and generates no thrust, except for aero drag forces. The canard winglet 50 has a section of a gear 52 just above the upper surface of the support strut, and this gear is rotated by a servo 51 in the strut 47 which supports the canard winglet 50 as shown in FIG. 6. The two sail arms 45 and 46 (not shown) in FIG. 8A, are fixed to the aero foil 42 and are 120 degrees apart 53; these sail arms hold the bottom end of the cables (not shown) to which the leading edge of each sail 14 of the sail set is fixed. These cables are attached to a roller furling devices at the end of each sail arm which allows the sails to be furled around this cable when desired, or to unfurl the sails when the boom 33 is being lowered into its deployed configuration under the loading of the boom yang cable, where these component provide the means for furling and unfurling the sail set 14 on each mast assembly 6 and 7. The top of each sail set cable is fixed to the head of the aero foil, and has a bearing 56 which allows the sail furling rotation by the action of roller fuller device.

Figure 8B:
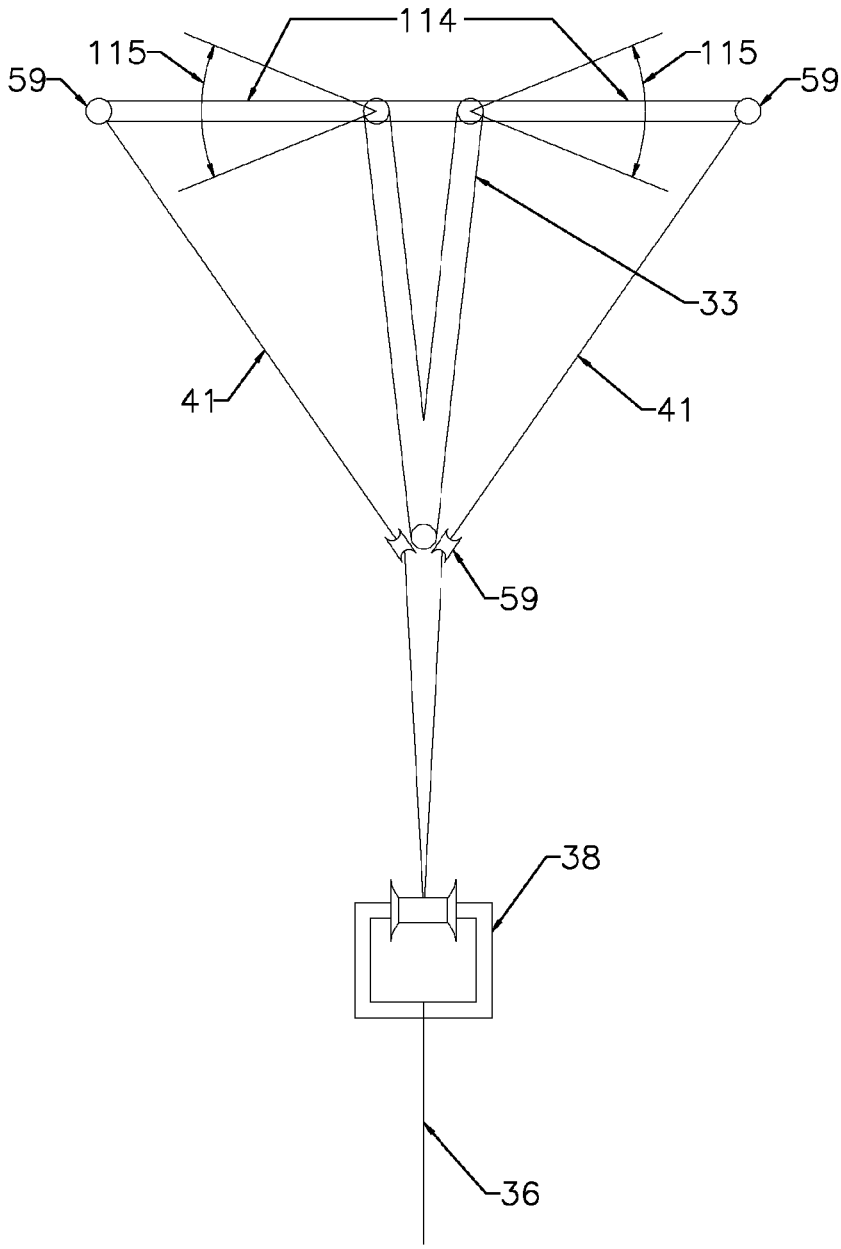
FIG. 8B is an end view of the boom of the mast assembly of the present invention, with the clew lines and sheaves shown.

FIG. 8B is an end view, Section BB in FIG. 8A, of the boom 33 of which is representative of one of two identical mast assemblies of the present invention, when in the unfurled sail configuration 113 in FIG. 8A. There are two pivot arms 114 at the outhaul section of the boom 33. These pivot arms have sheaves 59 on the end of the pivot arms, which pivot as shown 115. These pivot arms allow the sheaves 59 to line up with the load in the lines 41 from the sail clews as the aero foil 42 rotates about the mast assembly core 43.

Figure 9:
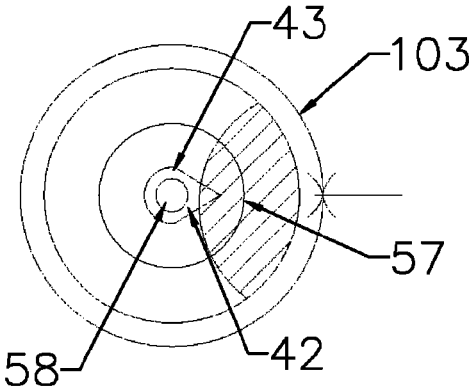
FIG. 9 is a top view of the counterweight housing of the mast assembly foot of the present invention showing the location of the weighted section of the counterweight.
Figure 10:
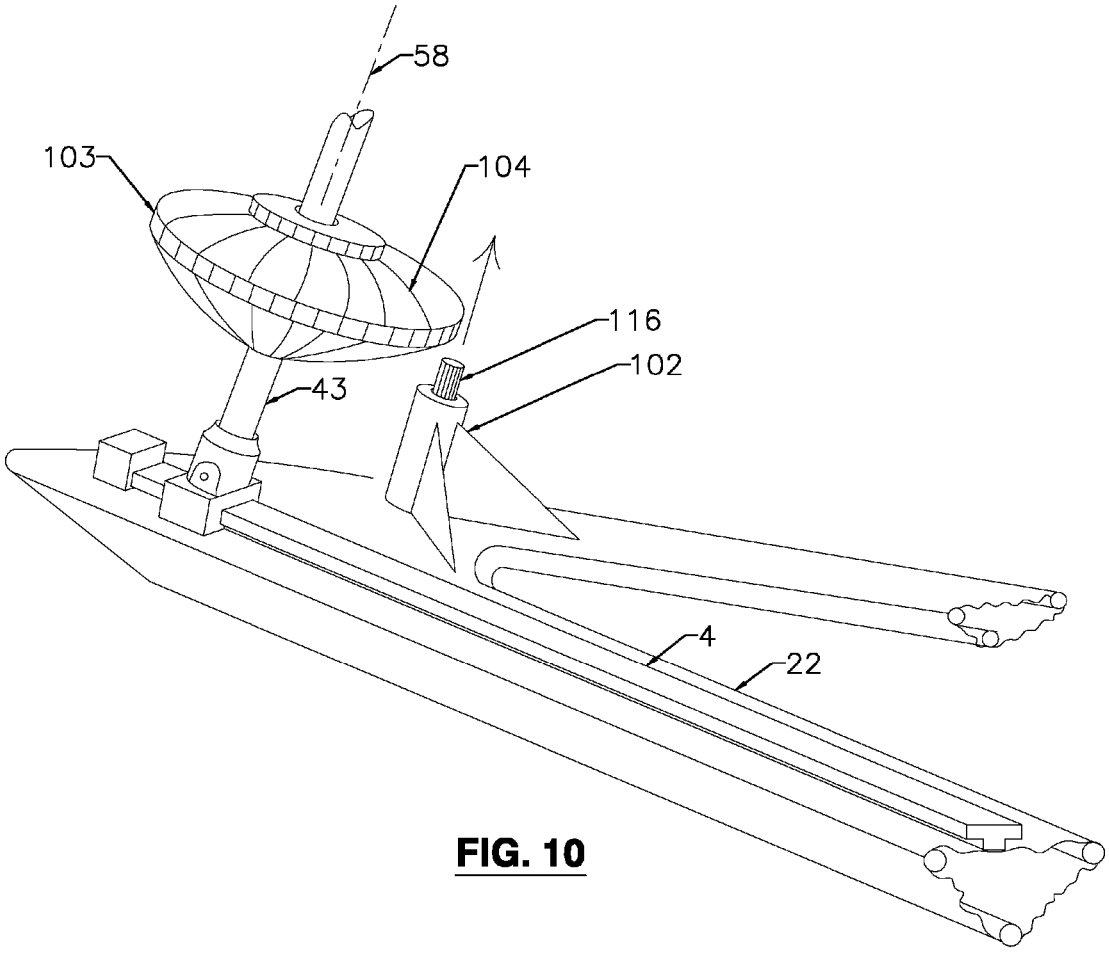
FIG. 10 is an isometric view of the counter weight and the counter weight rotator mechanism of the present invention.

FIG. 9 Illustrates a Section AA view of the rotatable counter weight 57 shown in FIG. 8A. This counterweight has a saucer like cowling configuration in which is embedded the actual counter weight component 57. This configuration makes the direction of the wind on the counterweight have no effect on the rotational drag forces on the mast assembly. Internal to the cowl 104 is the actual counter weight element 57 which provides a gravity torque on the mast assembly to counteract the weight of the sail sets and the aero foil 42 and its attachments such as the boom 33 under different operational configurations. This counterweight can be rotated (by a counterweight servo 171 which engages gear 173 on the top of the cowl 104), around the aero foil 42 to provide the required balancing of the aero foil 42 and its appendages under various deployed mast assemblies configurations as shown in FIG. 10, where these components provide a means for controlling the orientation of said aero foil rotation relative to said mast core This counter weight 57 is used for a three purposes. First it is used to adjust the center of weight of the deployed mast assembly to be located directly on the cylindrical axis 58 of the mast assembly core 43, in a plane perpendicular to the cylindrical axis of the mast assembly core 58, so that only the wind loads on the sail set 14 and the canard winglet 50 determine the stable and balanced rotation angle (about the mast assembly core cylindrical axis 58) of the aero foil 42 relative to the apparent wind—for the fully deployed mast assembly on the deployed space frame. This counter weight is required since the mast assembly core of each mast assembly is not vertical, but at an angle relative to the horizontal plane.

FIG. 10 is an isometric view of the counter weight and the counter weight rotator mechanism of the present invention. As previously mentioned, in order for the fully deployed mast assembly to respond to the apparent wind whether in the weathervane mode or in the thrust mode, the center of mass of the entire mast assembly must fall on the mast core cylindrical axis of the mast assembly core 58. This counter weight can be used to set a specific angle for the boom on each mast assembly when thrust in a specific direction is required when underway. Specifically it is used to adjust the nominal angle that the two mast assembly booms make with each other in preparation for broad reach sailing, tacking, and downwind sailing. The other purpose of the counter weights, on each deployed mast assembly, is to rotate the two mast assembly assemblies to the minimum potential energy configuration so that they fold down flat when the two mast assembly assemblies and fore spar are lowered into the pre-deployed configuration, as shown in FIG. 3. This is accomplished (when there is significant wind loads on the mast assembly assemblies), by a ring gear 49 on the outside diameter of the counterweight cowl 103 in FIG. 10 on the of the counter weight saucer cowling 104, as shown in FIG. 10. This ring gear 49 mates with the pinion gear 116, when these are engaged as explained below, where these components provide the means to balance the mast assembly around its mast core cylindrical axis 58. In order to move the mast assembly assemblies into the pre-deployed configuration, the foot of each mast assembly is moved to the respective extreme end of its rail (vertex 2 and vertex 3 in FIG. 2). At this point there is located a solenoid 102 with a servo motor, as shown in FIG. 10 that is fixed to the space frame near vertex 2 (shown here) and vertex 3 (not shown here) in FIG. 2. When in this mass assembly configuration, and after the boom is up and the sails are furled, on each mast assembly, the solenoids 102 are activated and these move the corresponding pinion gears 116 up so that they engage the ring gear 103 on the outside diameter of each of the counter weight cowling 104 in FIG. 10. These components provide the means to rotate the aero foil and the mast core of each mast assembly. Once engaged, the servos rotates the counter weight cowlings and since they are fixed to their respective aero foil's and the mast assembly cores, both mast assembly assemblies are rotated to the desired orientation for transition to the pre-deployed configuration. Once in this configuration the mast assembly core on each mast assembly is locked by a mechanism (not shown) so that it can no longer rotate in its bearing on top of each respective trolley. Now the foot of each mast assembly is moved by its trolley back toward the solar dome, as this proceeds, the superstructure of the space frame, which includes the mast assembly assemblies and the fore spar, all fold down until these three superstructure components rest in the respective saddles as shown in FIG. 2 and FIG. 3.

Figure 11:
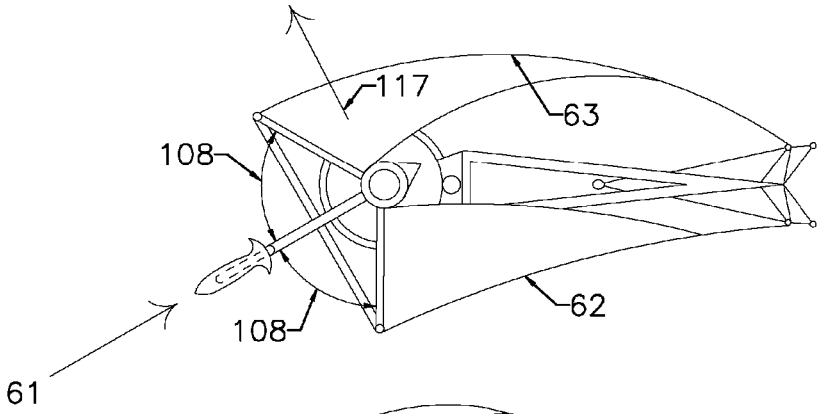
FIG. 11 is a top view of the mast assembly, of the present invention with the sail set shown creating thrust from the apparent wind do to a small relative rotation clockwise of the boom section of the mast assembly with respect to the aero foil section of the mast assembly.
Figure 12:
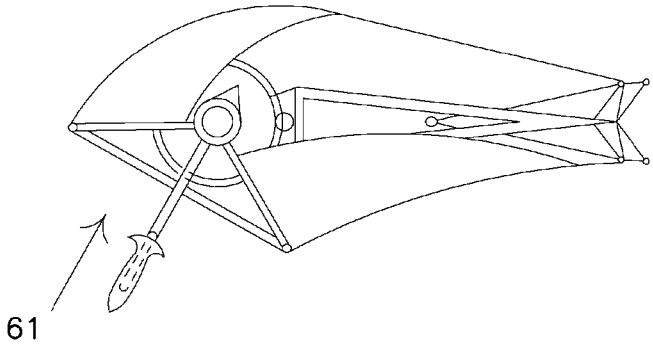
FIG. 12 is a top view of the mast assembly, of the present invention with the sail set shown creating thrust from the apparent wind do to a large relative rotation clockwise of the boom section of the mast assembly with respect to the aero foil section of the mast assembly.
Figure 13:
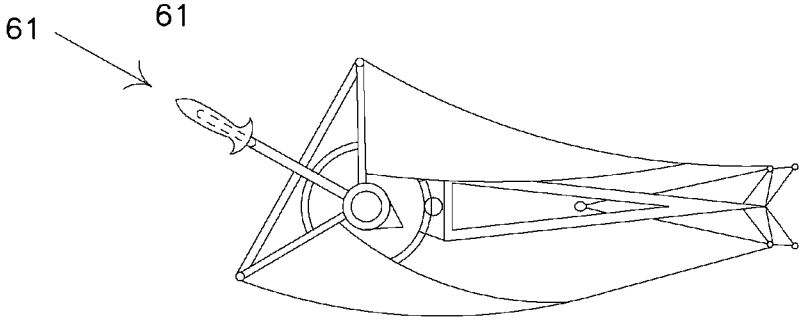
FIG. 13 is a top view of the mast assembly, of the present invention with the sail set shown creating thrust from the apparent wind do to a small relative rotation counter clockwise of the boom section of the mast assembly with respect to the aero foil section of the mast assembly.
Figure 14:
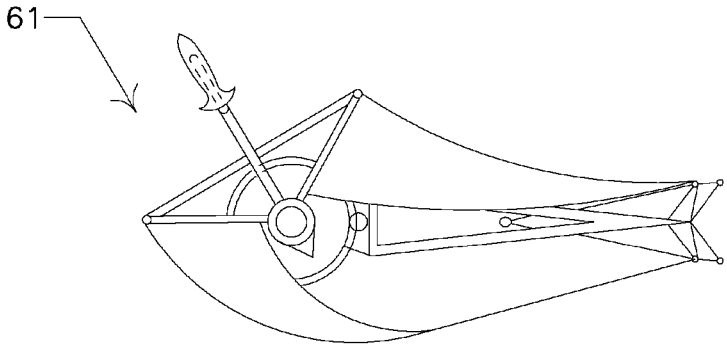
FIG. 14 is a top view of the mast assembly, of the present invention with the sail set shown creating thrust from the apparent wind do to a large relative rotation counter clockwise of the boom section of the mast assembly with respect to the aero foil section of the mast assembly.

FIGS. 11, 12, 13, and 14 are top views of one of two identical mast assemblies, of the present invention. In FIG. 11, the sail set 14 shown is creating thrust 117 from the apparent wind direction 61 due to a small relative rotation clockwise of the boom section of the mast assembly with respect to the aero foil section of the mast assembly. The rotation of the aero foil relative to the boom on the mast assembly core via the aero foil servo 48 on the ring gear 103 on the counterweight cowl 104 the causes the wind to generate thrust 117 on the mast assembly, 6 or 7. FIG. 12 is similar to FIG. 11, but there is a larger relative rotation of the aero foil relative to the mast assembly core and the boom which is fixed to it. FIG. 13 is a top view of the mast assembly, of the present invention with the sail set shown creating thrust from the apparent wind do to a small relative rotation counter clockwise of the boom section of the mast assembly with respect to the aero foil section of the mast assembly, and FIG. 14 is a top view of the mast assembly, of the present invention with the sail set shown creating thrust from the apparent wind do to a large relative rotation counter clockwise of the boom section of the mast assembly with respect to the aero foil section of the mast assembly. In each of these figures the canard winglet 50 shown in FIG. 8A is in the nominal configuration, and so it doesn't contribute to the torque acting to rotate the mast assembly in the clockwise or counter clockwise direction about the cylindrical axis of the mast assembly core 58. If the canard winglet had been rotated it could provide fine tuning to the torque on the mast assembly relative to the apparent wind direction 61 and this affect the rotation of the mast assembly and the wind related thrust generated by it.

Figure 15:
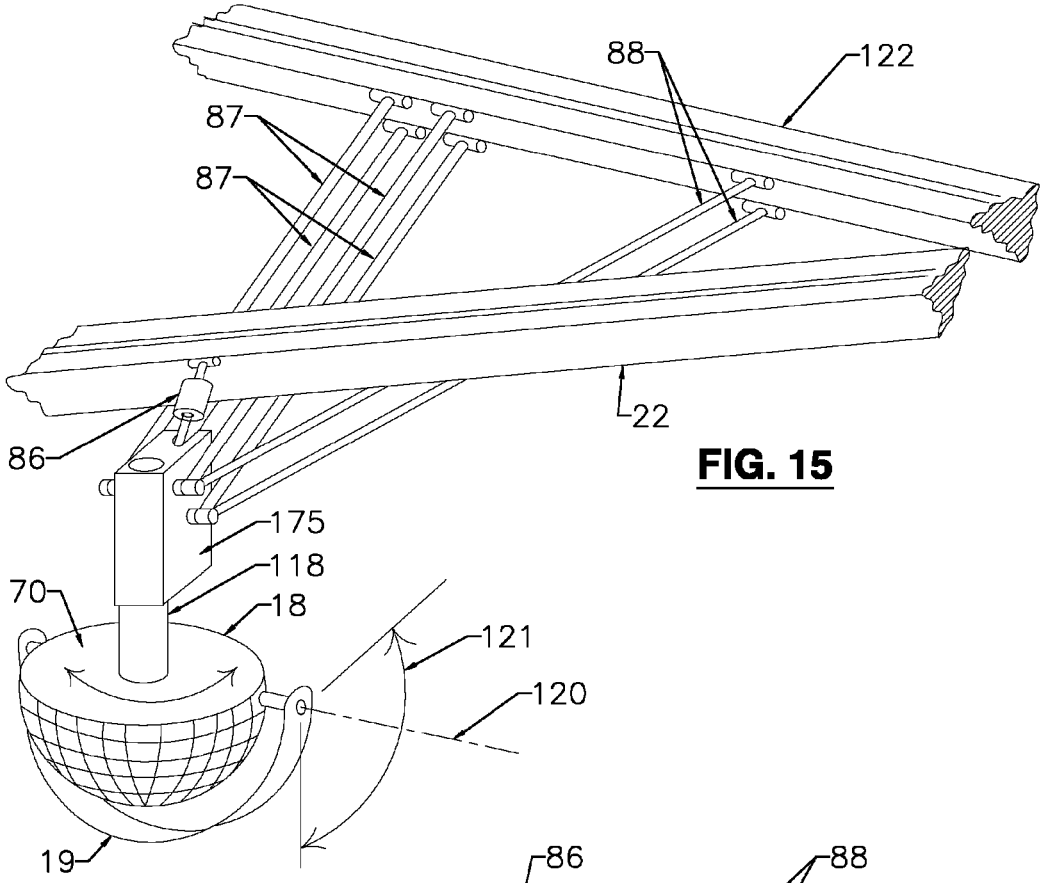
FIG. 15 is an isometric view of the rudder assembly and its support structure connection to the sailing space frame of the present invention—this is also a mirror image of the dagger assembly support structure.

FIG. 15 is an isometric view of a section of the space frame's aft deck beam 22 and the central deck beam 122 showing the rudder assembly 70 and its support structure connection to the space frame 5 of the present invention. The rudder assembly 70 is comprised of the rudder hull 18, the semi ring wing foil 19 and the central vertical shaft 118. The dagger board assembly 71 (not shown) is a mirror image of the rudder assembly and incorporates the same components. The rudder assembly support structure and the dagger assembly support structure both incorporate the articulation structures 88 and 89, which are hinged to the central deck beam 122, and hinged to the central vertical shaft housing 175, where these components provide the means for supporting the rudder assembly and the dagger assembly. These are used to support the rudder and dagger board assemblies, 70 and 71 respectively through the central vertical shaft 118 in the central vertical shaft housing 175; these components comprise the articulation structures for the rudder and dagger assemblies. These articulation structures utilize a parallelogram mechanism 87 to assure that the central vertical shaft 118 of each of these two hulls remains vertical independent of the elevation of the rudder hull 18, and the dagger board hull 119 in FIG. 2—independent of the wave action below them. The central vertical shaft housing 175 for the rudder and dagger assembly respectively also incorporates a servo for rotation of the their vertical shafts 118, used during maneuvers of the space frame 5, while coupled to or uncoupled from the vessel to be propelled 111. The angular struts 88 in FIG. 15 insure that the leeward loads imparted by the sails, and offset by the rudder board semi ring wing foil 19 (and similarly for the dagger board semi ring wing foils, not shown) are transmitted to the space frame 5—see broad reach sailing configuration in FIG. 43. These angular struts 88 are also fixed through a hinge mechanism to the central deck beam 122. The semi ring wing foils are capable of being mechanically raised 121 by rotation about their hinge axis, 120, this mechanism is not shown, for operation in shallow water. During the coupling process, to be explained later, the hydraulic ram 86 is used to raise the vertices 2 and 3 of the space frame 5, as shown in FIG. 2. The rudder and dagger assemblies provide a means for providing leeward resistance, and a means for directional control, for the vessel to be propelled.

Figure 16:
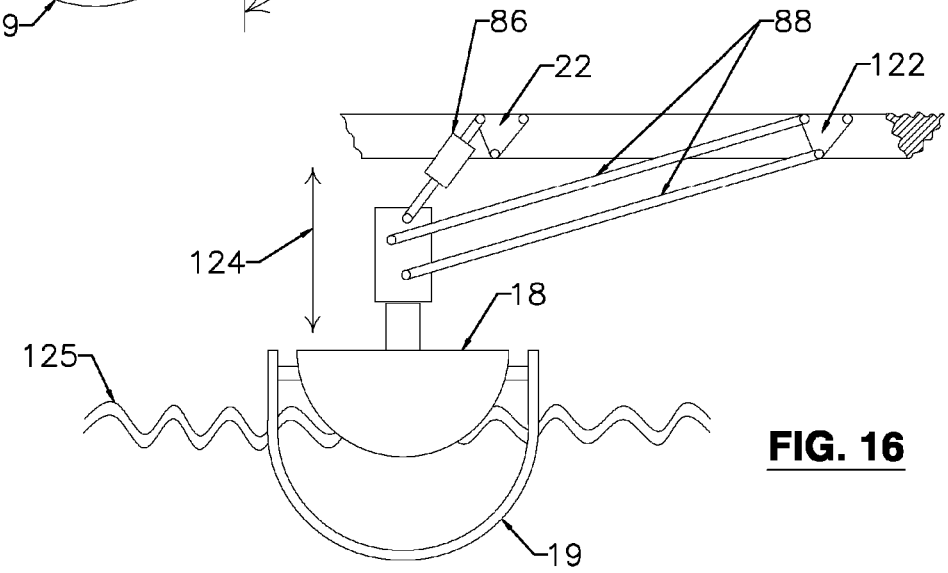
FIG. 16 is a front view of a section of the space frame's central deck beam, which shows rudder assembly's range of elevation of the present invention—this is also a mirror image of the dagger assembly support structure.

FIG. 16 is a front view of a section of the space frame's aft deck beam 22 and the central deck beam 122, as shown in FIG. 15, which shows rudder assembly's 70 vertical elevation range 124, which can be moved downward relative to the triangular base of the space frame 5, via the hydraulic ram 86, or can be allowed to just float on the surface of the ocean 125 (when the space frame 5 of the present invention is coupled to a vessel to be propelled).

Figure 17:
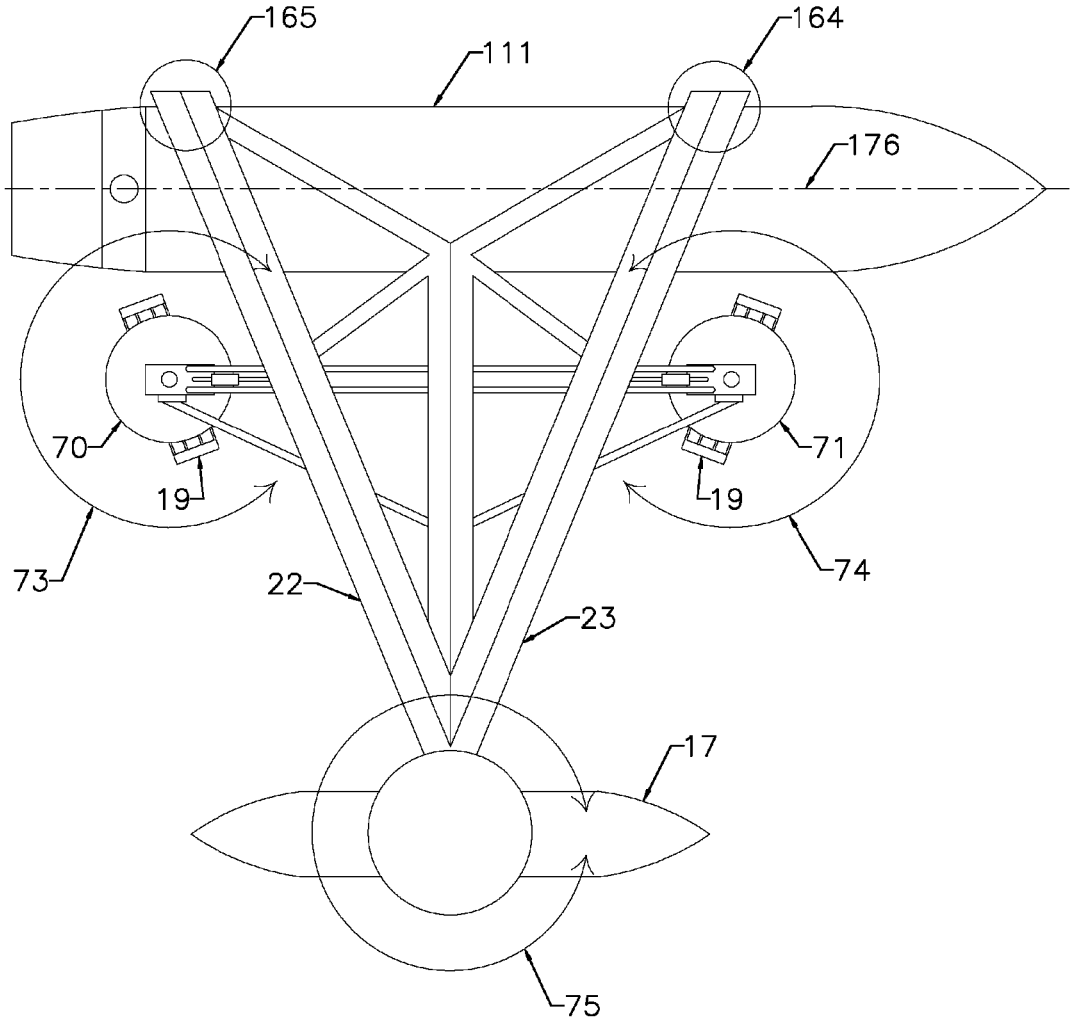
FIG. 17 is a plan view of the triangular deck of the space frame showing the rudder and dagger assemblies and their support structure connection to the sailing space frame of the present invention.

FIG. 17 is a plan view of the triangular base of space frame 5 showing rudder and dagger assemblies, 70 and 71 respectively, and the outrigger 17, and their associated 360 degree ranges of rotation 73, 74, and 75. The rudder and dagger board assemblies, can be rotated independently, by mechanical or electric actuators (not shown), for steering purposes both when the sailing space frame 5 of the present invention is coupled to a vessel to be propelled or when it is sailing independently (without being coupled to a vessel to be propelled). The outrigger 17 can be rotated by electrically driven thrusters which are incorporated into the outrigger hull 17, to be discussed in more detail later, which is also used in the coupling process to the vessel to be propelled, as well as to propel the sailing space frame 5 of the present invention, when not under sail. These functions will also be discussed in more detail later. The long axis 176 of the propelled vessel is also shown.

Figure 18:
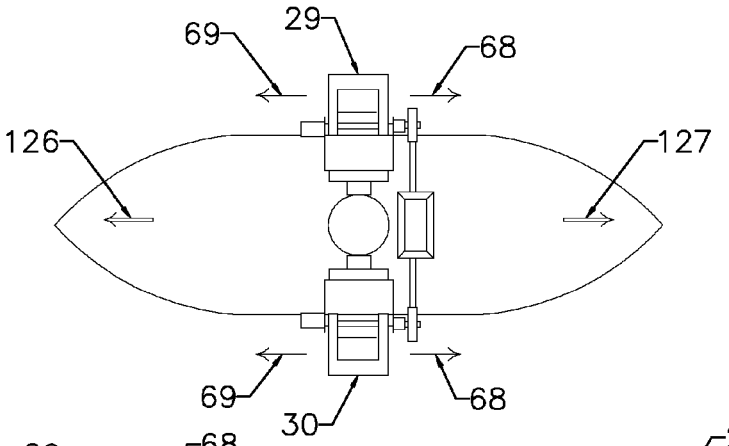
FIGS. 18, 19, 20, 21, 22, are top views of the outrigger hull with thrusters used for both propulsion and rotation of the outrigger hull of the present invention.
Figure 19:
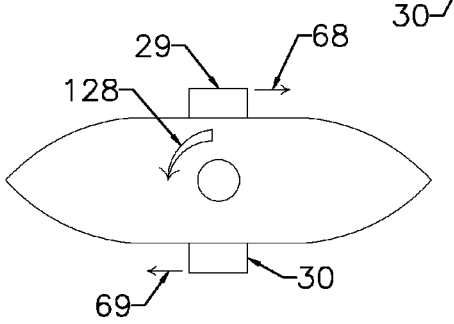
Figure 20:
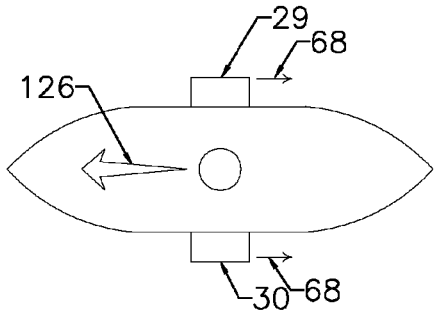
Figure 21:
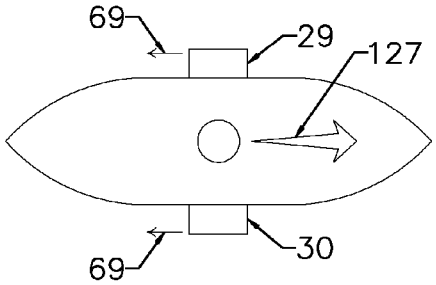
Figure 22:
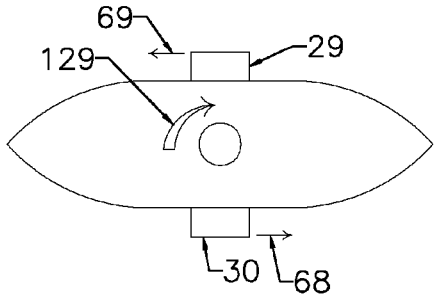

FIGS. 18, 19, 20, 21, 22, are top views of the outrigger hull 17 with thrusters in various positions when used for both propulsion and/or rotation of the outrigger hull 17 of the present invention. In FIG. 18, the two thrusters 29 and 30 are shown in the deployed configuration at the sides of the outrigger hull 17. In this configuration the thrusters can be used to provide thrust 68 in the same direction driving the outrigger hull 17 in the 126 direction, or alternately used to provide thrust 69 in the same direction driving the outrigger hull 17 in the 127 direction. More details of the thrusters and their connection to the outrigger hull are provided in FIG. 32. In FIG. 19, The thrusters are shown generating thrust in opposite directions, 68 and 69, thus rotating the outrigger hull 17 in the 128 counter clockwise direction, this would be used in the process of coupling to a vessel to be propelled or when decoupling from a propelled vessel, and will be discussed in more detail later. In FIG. 20, the thrusters are shown generating thrust in the same direction 68, thus propelling the in direction 126. Alternately in FIG. 21 the thrusters are generating thrust in the opposing direction 69, and propelling the outrigger in the direction 127. In FIG. 22, the thrusters are again shown generating thrust in opposite directions, 68 and 69 thus rotating the outrigger in the clockwise direction 129. The thrusters are also used to steer the present invention when it is not coupled to a vessel to be propelled and therefore acts in part as a rudder.

Figure 23:
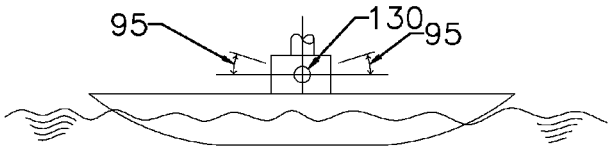
FIG. 23 is a side view of the outrigger hull with range of motion about horizontal shaft axis of the present invention.

FIG. 23 is a side view of the outrigger hull 17 with range of motion about horizontal shaft 130 of the present invention shown. The capability of the outrigger hull 17 to rotate about its horizontal shaft, serves two purposes. First it allows the outrigger hull to ride over waves instead of being forced to "plow through them". This reduces the drag forces on the outrigger hull when under way and reduces the torque that the outrigger hull 17 drag would have on the propelled vessel. This in turn allows more efficient propulsion by the sail sets 14 of the present invention in propelling the coupled vessel on the desired course. Secondly, the rotation of the outrigger hull 17 about its horizontal shaft 130 is retarded by an adjustable resistance regenerative braking system that provides the means to generate electricity and is mounted between the horizontal shaft 130 and the outrigger hull 17, to retard shaft 130 rotation 95, (this system is not shown), and is similar to that used on hybrid cars. Therefore when waves rotate the outrigger hull 17 about its horizontal shaft 130 electricity is generated in this regenerative braking system, stored in batteries and subsequently used for propulsion and control functions in the present invention. This will be discussed in more detail later. The outrigger also provides a means for reducing listing due to wind and wave loads on the coupled vessel under all operating conditions both under sail and when not under sail. A typical cargo ship or cargo vessel has a rounded bottom and no external keel so this type of hull provides little leeward resistance and also has a tendency to list under wind and wave loads which approach the vessel from a direction perpendicular to the long axis of the vessel 176.

Figure 24:
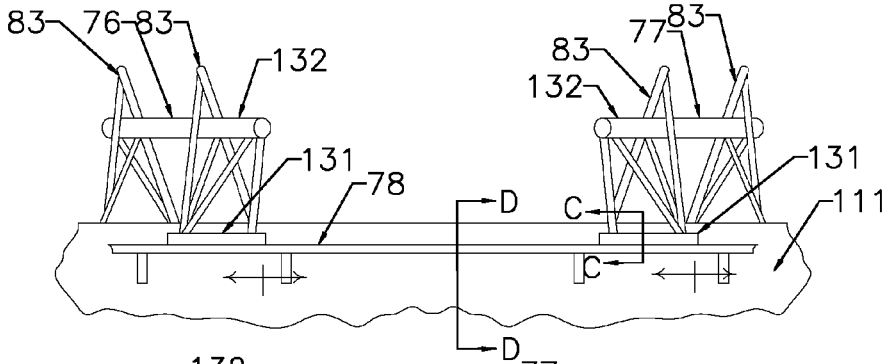
FIG. 24 Side views of bridges of the present invention attached to the side of the vessel to be propelled by space frame.
Figure 25:
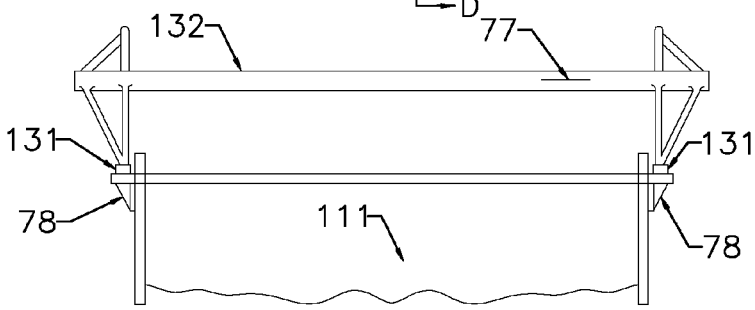
FIG. 25 is an end view of bridge attachment to vessel to be propelled by space frame of the present invention.

FIG. 24 is a side view of the two bridges 76 and 77 as located on the vessel to be propelled, which are used to couple the vessel to be propelled to the space frame 5 of the present invention. These two bridges are can be slid along the gunwale rails 78 which are mounted on both sides of the vessel to be propelled as shown in FIG. 25. The foot 131 at each end of each bridge, as shown in FIG. 26 can be slid along these rails and then fixed, by a mechanism (not shown) in the proper position in order to accommodate vessels to be propelled, by the present invention, whose hulls 111 have different beam widths.

FIG. 25 is an end view, Section DD of FIG. 24, of the bridge 77 attachment to vessel to be propelled by space frame 5 of the present invention, showing where the gunwale rails 78 are attached to the outside of the hull of the vessel to be propelled at approximately deck level. This position was chosen as a strong section of the hull where loads imposed by the bridges could be accommodated.

Figure 26:
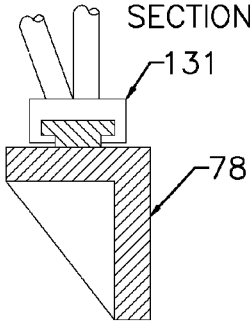
FIG. 26 is a cross sectional view of the bridge connection to the rail support of the present invention.

FIG. 26 is a cross sectional view, Section CC of FIG. 24, of the one foot 131 of the bridge 77 connection to the gunwale rail support 78 mounted to the side of the vessel 111 to be propelled, by the present invention. Each bridge 77 has two foot sections which are mounted to the gunwale rails 78 on either side of the vessel 111 hull to be propelled. The bridge 76, (not shown) is a mirror image of bridge 77.

Figure 27:
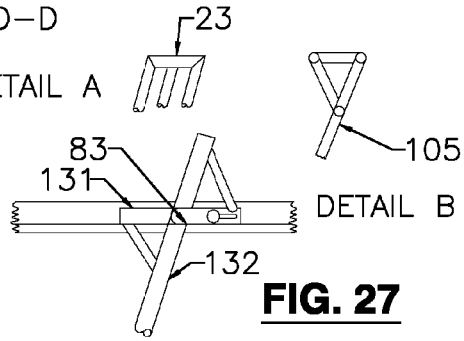
FIG. 27 is a plan view of the detailed bridge structure on the forward section on the port side of the vessel to be propelled used for coupling to the space frame of the present invention.

FIG. 27 is a plan view of the bridge 77 structure, of the present invention on the forward section of port side of the vessel to be propelled, (Detail 164, in FIG. 17), showing the details of the connection between the beam of the bridge 132, and the foot 131 of the bridge, and the approximately vertical portion 83 of the bridge 77. Detail A shows a top view of the end section of the fore deck beam 23 of triangular base of the space frame 5. Detail B shows and end view of this end section of fore deck beam 23 of the triangular base of the space frame 5 with the approximately vertical member 105, which is used to help locate the fore deck beam 23 onto the correct location on the beam of the bridge 132.

Figure 28:
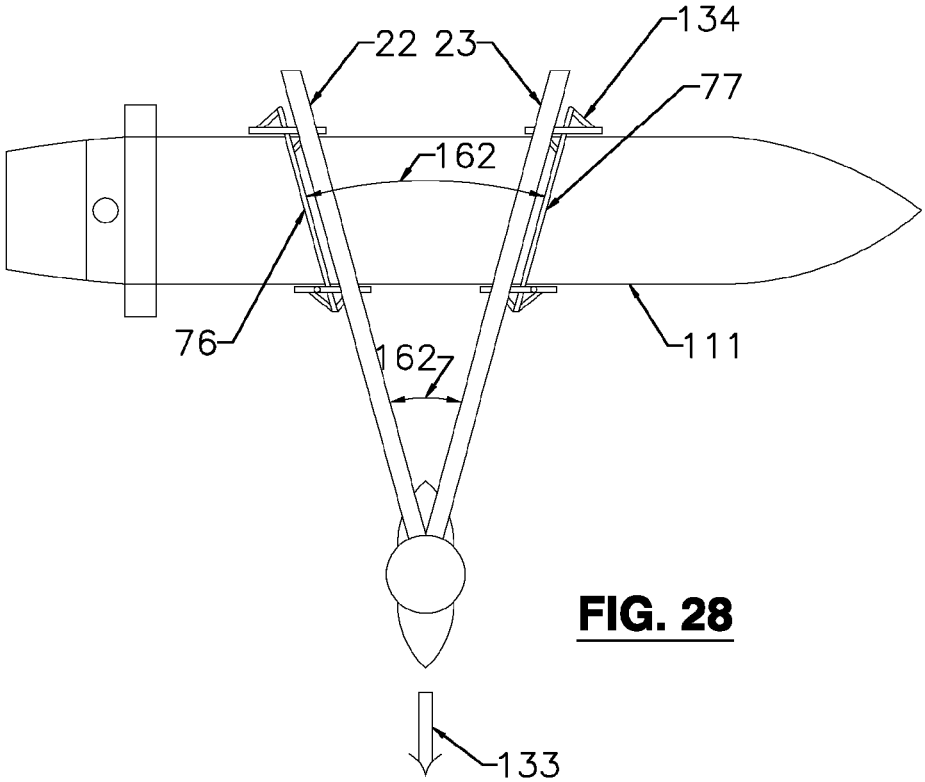
FIG. 28 illustrates a top view of the space frame triangular deck of the present invention above the subject vessel in the pre-coupled configuration.

FIG. 28 illustrates a top view of the just two beams 22 and 23 of the space frame triangular deck 5 of the present invention, located almost directly above the two bridges 76 and 77 of the vessel to be propelled. When the outrigger hull 17 is propelled in the direction 133, these two beams 22 and 23 slide into their final position above the corresponding bridges on the vessel, 76 and 77, and the coupling process is then initiated in FIG. 30 and then completed as shown in FIG. 31.

Figure 29:
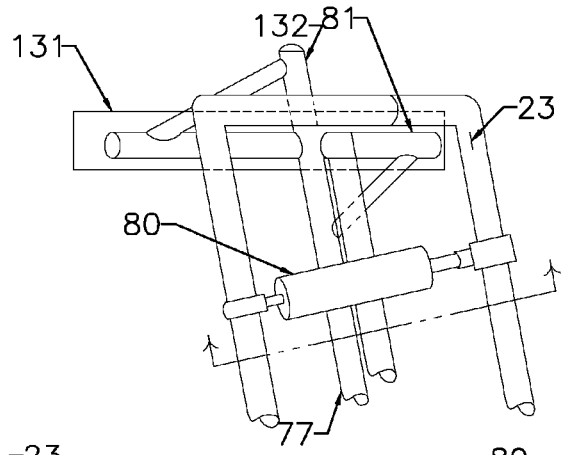
FIG. 29 illustrates a top view of coupling jaw mechanism and the corresponding section of the bridge of the present invention on the forward section of port side of the vessel to be propelled.
Figure 30:
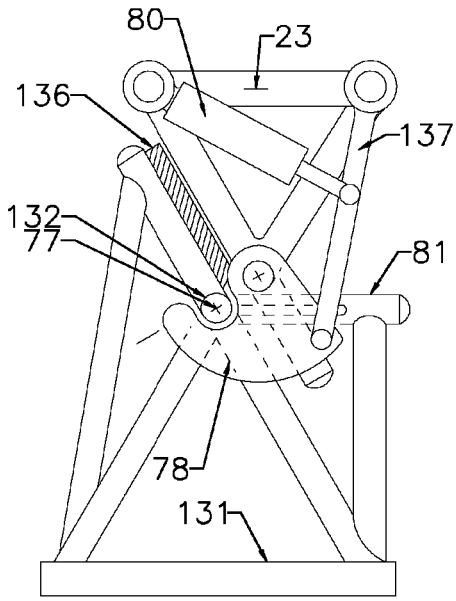
FIG. 30 illustrates a sectional view AA of FIG. 29 of the coupling mechanism in the locked position at the end of one bridge, of the present invention, on the aft port side of the vessel to be propelled.
Figure 31:
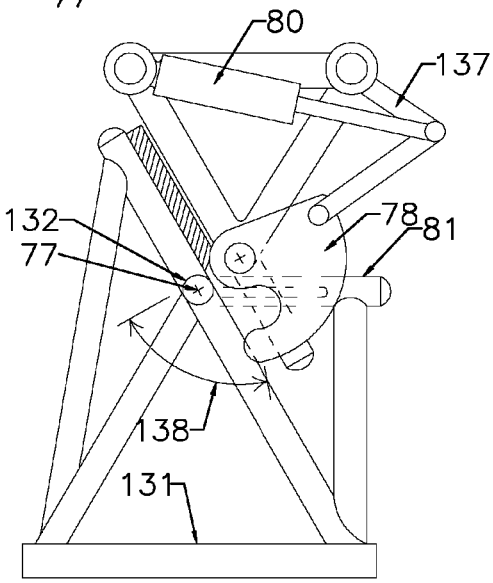
FIG. 31 illustrates a sectional view AA of the coupling mechanism in the unlocked position, at the end of one bridge, of the present invention, on the aft section of the port side of the vessel to be propelled.

FIGS. 29, 30 and 31, illustrate the configuration of the coupling between the fore deck beam 23 of triangular base of the space frame 5 with the bridge 77. A similar coupling configuration, which is a mirror image of that shown in this FIG. 27, is used between aft deck beam 22 of the triangular deck 5 of the present invention, and the bridge 76, but this is not shown here.

FIG. 29 illustrates a top view of coupling jaw 78 mechanism and bridge 77 of the present invention on the forward section of the port side of the vessel (location 134, in FIG. 28) to be propelled. The bridge beam 77 is shown, as well as the structure connecting the bridge beam 132 to the foot 131 of the beam 77. A horizontal portion 81 of the structure connecting the foot 131 to the beam 132 is used as a shelf to support the fore deck beam 23 of the triangular base of space frame 5 of the present invention, when it is lowered down onto the bridge beam 77. A hydraulic ram 80, is used activate the coupling mechanism 135, as shown in FIG. 30 and FIG. 31. A similar configuration and coupling jaw 78 mechanism is utilized on beam 76, not shown.

FIG. 30 illustrates a sectional view (AA in FIG. 29) of the coupling mechanism 135 in the locked position, of the present invention, on the forward section of the port side of the vessel to be propelled (in the location of the detail 165 in FIG. 17), where the hydraulic ram 80 is in the fully retracted configuration, and the jaw 78 of the coupling mechanism 135, driven by the linkage mechanism 137 has captured the bridge 77 beam 132 completely. Also shown is a pad 136 which is used to facilitate sliding of the fore deck beam 23 against the structure connecting the foot 131 of the bridge 77, during both the coupling and uncoupling process. The bridges 76 and 77, in combination with the two coupling mechanism 135 attached to the beams 22 and 23 of the triangular base of the space frame 5, comprise, in combination, the vessel coupling mechanism provides the means the coupling/uncoupling of the present invention to/from the vessel to be propelled.

FIG. 31 illustrates a sectional view (AA in FIG. 29) of the coupling mechanism 135 in the unlocked position, of the present invention, on the forward section on port side of the vessel to be propelled, (as shown in detail 165 in FIG. 17). To move the jaw 78 from the locked position shown in FIG. 30 to the unlocked position shown in FIG. 31, the jaw 78 must be rotated by the hydraulic ram 80, via the linkage mechanism 137, through the arc 138. This is the configuration of the coupling mechanism 135, when the beams 22 and 23 of the space frame of the present invention is being either lowered on to the bridges 76 and 77, or raised off the bridges 76 and 77, during the coupling of the space frame of the present invention on to, or off of, the vessel 111 to be propelled, respectively.

Figure 32:
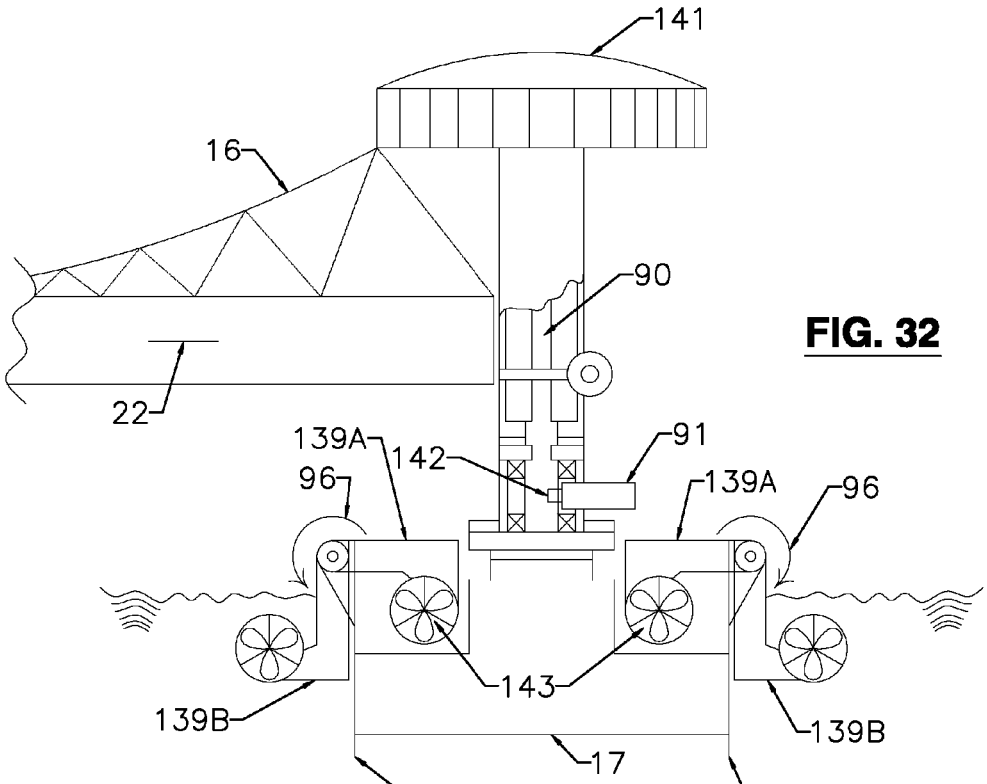
FIG. 32 is a side view of the outrigger hull connection to the bottom of the space frame of the present invention, and the two positions of the outriggers thrusters.

FIG. 32 is an end view of the outrigger hull 17 connection to the bottom of the triangular base of the space frame 5 of the present invention, with the crew's quarters 21, directly above the connection to the outrigger 17, and the solar dome 141 which serves as the roof of the crew's quarters. This solar dome is covered with solar cells which generate electricity for storage in a battery bank below the crew's quarters, for subsequent use in propulsion and control of the present invention both in the uncoupled configuration and the coupled configuration to a vessel to be propelled. Attached to the crew's quarters is the elevated section rail 16, of the horizontal section of the rail 4, which is structurally connected to the beam 122 below it. This elevated section of the rail 16, on beam 122, is where the fore spar trolley 24 moves is shown in FIG. 3. Also shown is a sectional view (AA in FIG. 33) of the outrigger 17, showing the two positions of the outrigger's electric thrusters 143, where the configuration 139A shows these thrusters in the pre-deployed position inside the outrigger hull 17, and 139B, with the thrusters 143 showed in the deployed position below the water line on the sides of the outrigger hull 17, respectively. Above the outrigger is the outrigger connection shaft 90, as shown in detail in FIGS. 34 and 35, between the outrigger 17 hull and the triangular base of the space frame 5 of the present invention. As mentioned the outrigger 17 hull can be rotated by the use of the two thrusters 143, and once in it is desired angular rotation position relative to the triangular base of space frame 5, it can be locked in this position by the solenoid 91 which moves a locking pin 142 into a corresponding socket hole in the outrigger connection shaft 90. There are two socket holes (not shown) in the outrigger connection shaft 90 corresponding to two different rotation locations 90 degrees apart for the outrigger hull 17 relative to the triangular base of space frame 5 orientation of the present invention. One socket whole location corresponds to the outrigger hull orientation perpendicular to the long dimension of the vessel to be propelled during the coupling process, and the other corresponds to the orientation of the outrigger parallel to the vessel to be propelled when the present invention is coupled to it and under way.

Figure 33:
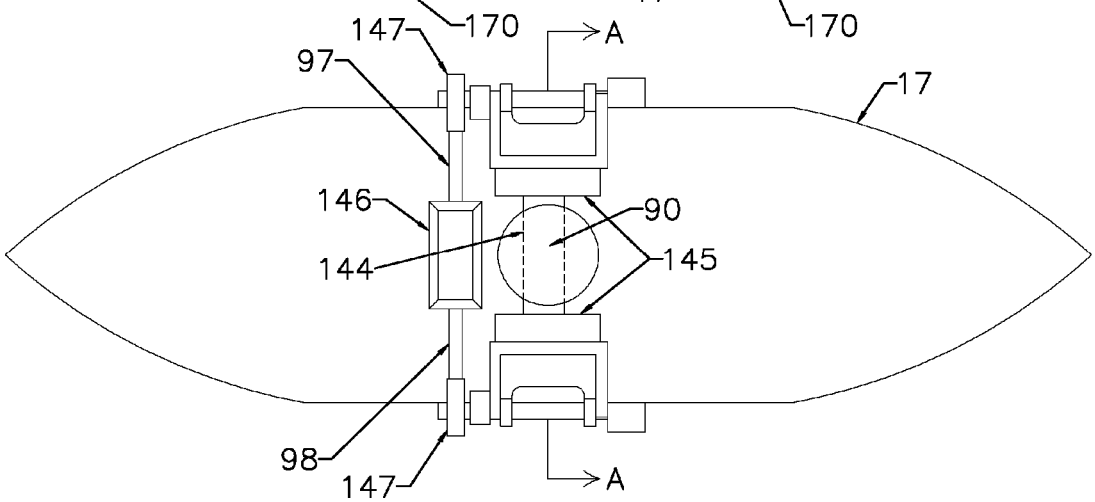
FIG. 33 is a plan view of the outrigger hull of the present invention, showing the housing of the outrigger thrusters in the pre-deployed configuration.

FIG. 33 is a plan view of the outrigger hull 17 of the present invention, showing the housing of the outrigger electric thrusters 143 in the pre-deployed configuration. The outrigger connection shaft 90 is fixed to the horizontal shaft 144 shown, which allows the outrigger hull 17 hull to ride over waves as shown in FIG. 23. This shaft 144 is connected to the regenerative braking components 145, which also house the bearings for this shaft 144, which are fixed to the outrigger hull 17. The rotation of the thrusters 143 from their housing in the outrigger hull 17 into the water is accomplished by the activation of the electric motor 146, which has one single shaft with the section 97 having a right hand worm thread on it and the other section 98 having a left hand worm thread on it. The rotation of this shaft causes the corresponding worm wheels in their housings 147 to rotate the thrusters 143 either into the water, or out of the water back into the outrigger hull 17, depending on the rotation sense of the electric motor 146.

Figure 34:
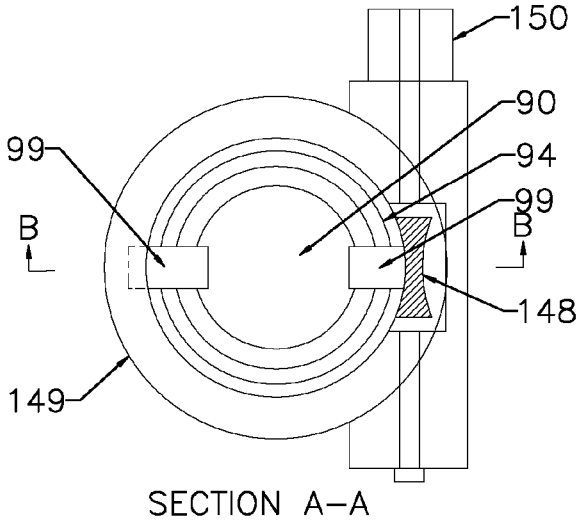
FIG. 34 is a top cross sectional view of the outrigger connection shaft and elevation mechanism supporting the outrigger hull of the present invention.

FIG. 34 is a top cross sectional view (AA in FIG. 35) of the outrigger connection shaft 90 and elevation mechanism components supporting the outrigger hull 17 of the present invention. The outrigger connection shaft 90 has a square threaded section 93, which is keyed into the housing 149 by keys 99 that fit into two corresponding grooves in the outrigger connection shaft 90.

Figure 35:
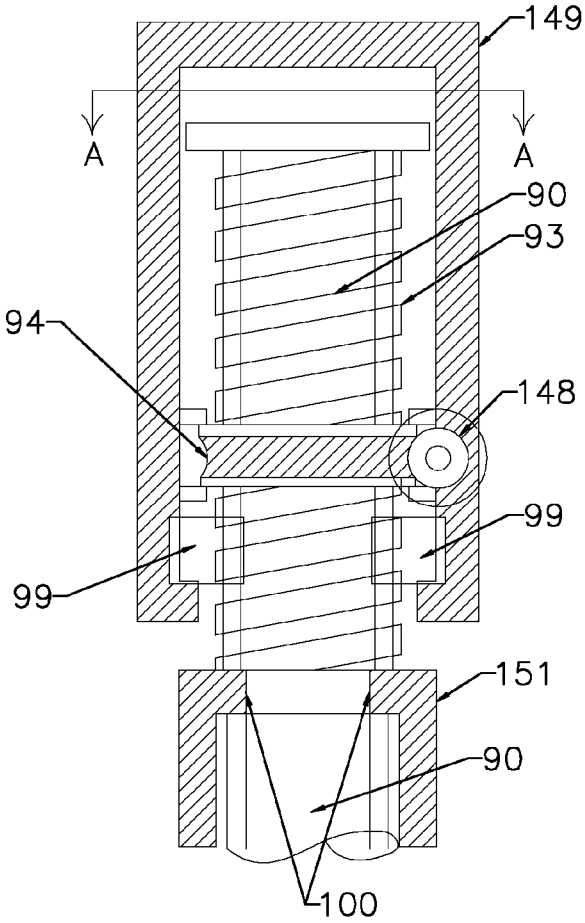
FIG. 35 is a side cross sectional view of the outrigger connection shaft and elevation mechanism, of the present invention.
Figure 36:
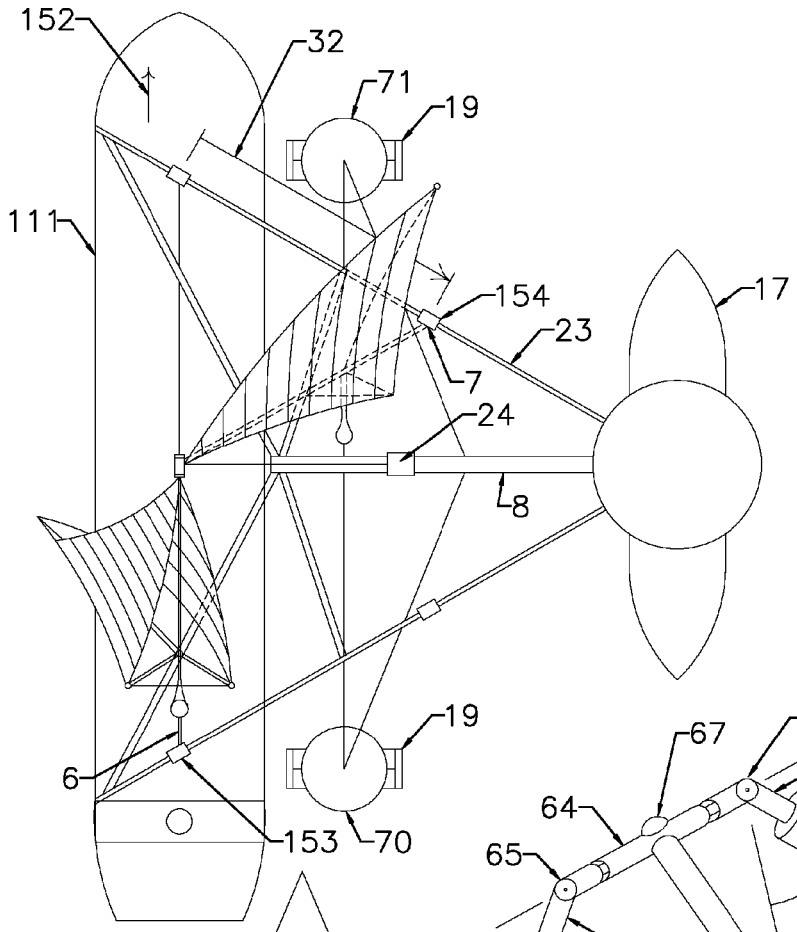
FIG. 36 is a plan view of the present invention showing the sailing space frame coupled to a propelled vessel sailing downwind.

FIG. 35 is a sectional view BB in FIG. 34 of the outrigger elevation mechanism, of the present invention, and shows how the outrigger connection shaft 90 fits inside a worm wheel 94 which has screw internal threads (not shown) which mate with the external threads 93 on the outrigger connection shaft 90. When the worm wheel 94 is rotated by an electric motor 150, (in FIG. 34), through the worm gear 148, the outrigger connection shaft 90 can be raised or lowered, depending on the sense of the rotation of the motor 150. The outrigger elevation mechanism provides the means to elevate the triangular base of the space frame 5 above the outrigger 17. The housing 151 for the outrigger connection shaft 90 is fixed to the outrigger hull 17, also incorporates a ring section 100, which fits into a corresponding groove in the outrigger connection shaft 90, which cause the outrigger hull 17 to move up and down with the vertical motion of the outrigger connection shaft 90. If the lock pin 142 driven by the solenoid 91 is disengaged from the corresponding hole in the outrigger connection shaft 90 the housing 151, the attached outrigger hull 17 can be rotated by the thrusters 143 on the outrigger hull 17, in FIGS. 19 and 22, when they are submerged below the water line in configuration 139B as shown in FIG. 32, FIG. 36 is a plan view of the present invention coupled to a propelled vessel sailing downwind. In order for both mast assembly sail sets 14 to see clean air 155, when sailing downwind, the mast assembly trolley 153 of mast assembly 6 remains in its nominal location, as shown in FIG. 5, while the mast assembly trolley 154 of mast assembly 7 is moved along its rail 4 on fore deck beam 23 a distance 32, so that it can see also clean air 155. This motion 32 of the mast assembly trolley 154 of mast assembly 7, can require some slight compensating motion (by a mechanism—not shown) of the fore spar 8 foot 24 along the rail 16 on beam 122 on the triangular base of space frame 5.

Figure 37:
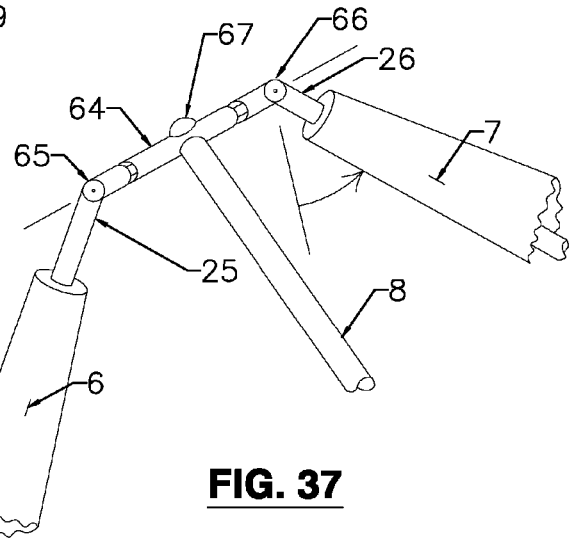
FIG. 37 is an isometric view of the two mast assembly head connections to the head of the fore spar of the present invention.

FIG. 37 is an isometric view of the heads of the mast assembly cores 25 and 26 to the universal joint connections 65 and 66, of the mast assembly assemblies 6 and 7 respectively, to the "T section" 64 at the head of the fore spar 8 of the present invention. This configuration allows the movement of the mast assembly foot trollies 153 and 154 and the fore spar trolley 24 of the fore spar 8 to be moved along their respective rails 4, without any undo stresses in this "T section" 64 connection point, during deployment of the mast assembly assemblies and the fore spar and folding down into the pre-deployed configuration as shown in FIGS. 3, and 5. Similarly, during motion of the mast assemblies and the fore spar for downwind sailing this "T-Section 64" configuration will allow motion of these components along their respective rails without undue stress at this connection point. A radar dome 67 is located at the top of the "T-Section" 64.

Figure 38:
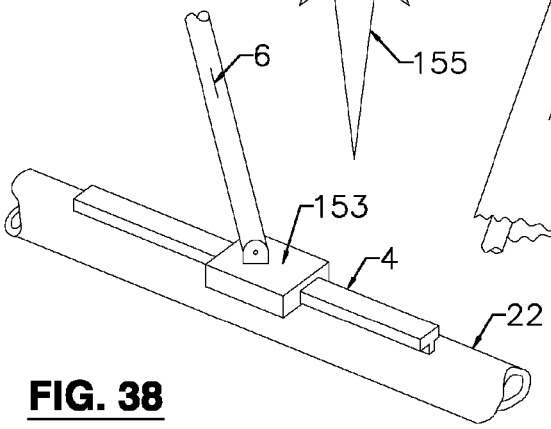
FIG. 38 is an isometric view of a typical mast assembly foot connection riding on a rail on the space frame of the present invention.

FIG. 38 is an isometric view of the mast assembly trolley 153, of mass assembly 6 riding on its rail on the aft deck beam 22 of the triangular base of space frame 5 of the present invention. If required, movement of the mast assembly trollies 153 and 154 and the fore spar trolley 24 along their respective rails can be accomplished by electro-mechanical means (not shown).

Figure 39:
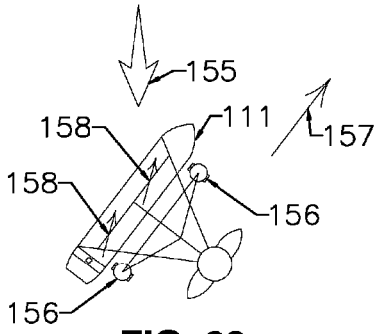
FIG. 39 is a plan view of the sailing space frame, of the present invention coupled to a vessel being propelled on a starboard tack.
Figure 40:
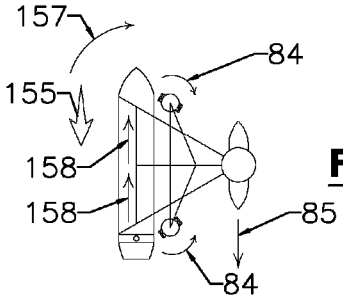
FIG. 40 is a plan view of the sailing space frame, of the present invention coupled to a vessel being propelled and coming about.

FIG. 39 is a schematic plan view of the sailing space frame, of the present invention coupled to a vessel being propelled on a starboard tack, with the rudder and dagger board in the nominal position 156 after going through a tacking maneuver as shown in FIG. 40, and the wind direction 155, and moving in direction 157. Sail set 14 orientations 158 are indicated by arrows.

FIG. 40 is a schematic plan view of the sailing space frame, of the present invention coupled to a vessel being propelled during a coming about maneuver, with the wind direction 155, where the effect of the rudder and dagger board rotations 84 are assisted by the reverse thrust 85 provide by the thrusters 143 as shown in FIG. 32, which are used to retard the forward motion of the outrigger hull 17, allowing the propelled vessel 111 to pivot about the outrigger hull 17 and make a more rapid tacking maneuver than would be possible without the use of the outrigger thrusters, and moving in direction 157. Sail set 158 orientations are indicated by arrows. This use of the thrusters would only be required in light winds where the forward momentum of the propelled vessel and the coupled space frame would not be adequate to come about and still keep forward motion while the sails are in irons 158.

Figure 41:
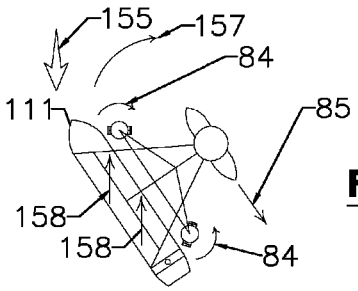
FIG. 41 is a plan view of the sailing space frame, of the present invention coupled to a vessel being propelled on a port tack.

FIG. 41 is a schematic plan view of the sailing space frame, of the present invention coupled to a vessel 111 being propelled, and the wind direction 155, shown at the beginning of the transition from a port tack to coming about, with the rudder and dagger boards rotated in direction 84 and the outrigger hull 17 hull using the reverse thrust 85 of it thrusters 143 to retard the forward motion of the outrigger and allowing the propelled vessel to pivot about the outrigger hull 17 and make a more rapid tacking maneuver than would be possible without the use of the outrigger thrusters, and moving in direction 157. Sail set 158 orientations are indicated by arrows. This use of the thrusters would only be required in light winds where the forward momentum of the propelled vessel and the coupled space frame would not be adequate to come about and still keep forward motion while the sails are in irons.

Figure 42:
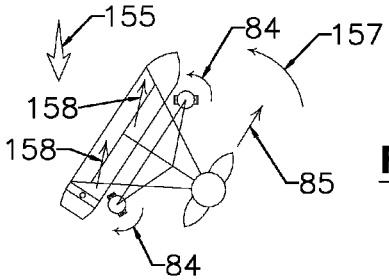
FIG. 42 is a plan view of the sailing space frame, of the present invention coupled to a vessel being propelled on a starboard tack.

FIG. 42 is a schematic plan view of the sailing space frame, of the present invention coupled to a vessel 111 being propelled on a starboard tack at the beginning of the transition to a port tack, and the wind direction 155, where the rudder and dagger boards are rotated in the direction 84, and the thrusters 143 on the outrigger hull 17 is used to speed up the forward motion of the outrigger increasing the motion of the propelled vessel more rapidly through the tacking maneuver than possible without the use of the outrigger thrusters, and moving in direction 157. Sail set 158 orientations are indicated by arrows. This use of the thrusters would only be required in light winds where the forward momentum of the propelled vessel and the coupled space frame would not be adequate to come about and still keep forward motion while the sails are almost irons.

Figure 43:
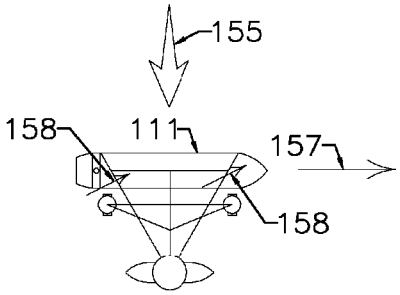
FIG. 43 is a plan view of the sailing space frame of the present invention coupled to a vessel being propelled sailing on a broad reach.

FIG. 43 is a schematic plan view of the sailing space frame of the present invention coupled to a vessel 111 being propelled, on a broad reach, with wind direction 155, and moving in direction 157. Sail set 158 orientations are indicated by arrows.

Figure 44:
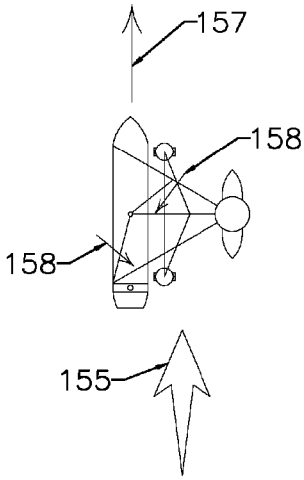
FIG. 44 is a plan view of the sailing space frame of the present invention coupled to a vessel being propelled sailing downwind.

FIG. 44 is a schematic plan view of the sailing space frame of the present invention coupled to a vessel 111 being propelled downwind in direction 157, with the wind coming from direction 155. Sail set 158 orientations are indicated by arrows.

FIG. 45 is a side view of the sailing space frame of the present invention in the process of coupling to the vessel to be propelled, with the two mast assemblies and the fore spar in the pre-deployed configuration, and the outrigger moving perpendicular 159 to the starboard side of the vessel to be propelled, and the semi ring wing foils 19 on both the rudder and dagger board hulls 70 and 71 rotated to line up with the direction of motion 159 of the outrigger.

FIG. 46 is a side view of the sailing space frame of the present invention when it is elevated above the vessel to be propelled, by the downward activation of the hydraulic rams 86 (not shown), above the rudder and dagger board hulls 70, and 71, and the corresponding downward movement of the outrigger by accomplished by its outrigger connection shaft 90 (not shown), with the two mast assemblies and the fore spar in the pre-deployed configuration. The triangular base of space frame 5 must be above and clear the bridges 76 and 77, in order to be in position to be lowered on to these bridges.

FIG. 47 is a side view of the sailing space frame of the present invention when the space frame is being lowered, in the direction 160 onto the bridges mounted to the vessel to be propelled, until the beams 22 and 23 of the triangular base of space frame 5 rests on the typical shelf 81, as shown in FIG. 31.

FIG. 48 is a side view of the sailing space frame of the present invention when it is being coupled to the vessel to be propelled, with the two mast assemblies and the fore spar in the pre-deployed configuration. At this point in the coupling process, the thrusters on the outrigger are reversed and the outrigger now pulls the triangular base of space frame 5 away from the vessel to be propelled in direction 82 in order for the beams 22 and 23 of the triangular base of space frame 5 to be in the final position relative to the bridges 70 and 71. At this point the four jaws 78 lock onto these beams and the coupling process is complete.

FIG. 49 is an end view of the sailing space frame of the present invention coupled to the vessel to be propelled, with the two mast assemblies, the fore spar, and the sail sets 14 in the fully deployed configurations, and the outrigger rotated, and rudder and dagger board hulls also rotated so that their semi ring wing foils are aligned for movement in a direction to be parallel to the length of the vessel, with the wind direction 161, and the vessel to be propelled moving on a broad reach under sail power.

The present invention has a number of improvements over prior art with respect to wind powered propulsion assistance for vessels that normally use fossil fuels for propulsion. A number of years ago, masts and square sails were installed on some of these types of vessels to provide additional propulsive forces using the wind. These concepts were tried but could only provide downwind propulsion, and the sail area carried was too small to supplant the use of the diesel engines. In addition wind that was not directly downwind along the desired course would cause leeward motion of the propelled vessel and also listing forces which were not desirable. Recently, use of kites for assisted propulsion of these vessels, which took advantage of the higher wind velocity at the higher elevation than sails, have been used and these are more efficient than the sails but still suffer from the same type of problems as the square sails initially used. The primary advantage of the present invention is that it addresses these problems and provides a means to propel a vessel without use of fossil fuels on the trans-ocean portion of the vessels voyage. The present invention provides a large rudder and dagger board surface which prevents leeward motion when the vessel is subject to winds that are not downwind. In addition the outrigger stabilizes the vessel against rolling, and allows the tall mast assemblies capable of carrying the very large sail area to replace the propulsion of the vessel with wind powered propulsion. The present invention will allow efficient sailing on a broad reach, close hauled and of course downwind sailing, so that the wind can be used on all points of sail. Finally, since the present invention can be coupled or decoupled from any vessel to be propelled, the vessel to be propelled doesn't have to enter or exit a harbor with the present invention coupled to it. The present invention only couples to the vessel to be propelled when the vessel is out at sea far from the harbor and the associated crowded shipping lanes in the near harbor areas. This feature also allows the present invention to be rapidly decoupled from the propelled vessel should this become necessary due to storm or other emergency conditions.

Rising concern about the cost of diesel oil and the associated pollution caused by its usage for propulsion in cargo and tanker vessels, has caused steaming speeds to be reduced from 25 Knots to 12 Knots by major carriers. This speed is below the speed of the sail powered Yankee Clipper Ships of the 19th century. Since sail powered ships followed the trade winds in the past, major shipping ports were established where the trade winds were most powerful, and this is very advantageous for the use of the present invention.

The present invention can temporarily transform a cargo, container, of tanker vessel into a pure sail powered vessel for a large portion of its trans-ocean voyage without the use of any diesel fuel. In addition the present invention can make the propelled vessel an efficient sailing vessel capable of sailing on a broad reach, a close reach, and of course, downwind (contrary to other wind based propulsion systems, such as kite based propulsion). As mentioned these other wind driven systems also incur other impacts on the propelled vessel such as increased listing forces.

For tanker vessels, the present invention can propel them when fully loaded, as well as when emptied. For empty tanker vessels, the use of the present invention eliminates the requirement for ballast water, since it stabilizes the vessel with its outrigger while significantly reducing the tonnage to be propelled. Current international restrictions being considered for ballast water processing before dumping, and are expected to greatly increase the cost of tanker vessel operation and many vessels would require refitting, and furthermore these requirements may make some existing vessels instantly obsolete due to financial constraints.

From a financial perspective the cost of diesel fuel for propelling one typical container vessel is very high. In addition this technology can serve to get the benefit of wind propulsion without building new sail power vessels, or incurring the cost of repowering the vessels by installing Gas Turbine Power Plants for propulsion. There is also regulatory pressure building for installing scrubbers on vessels propelled by diesel engines to remove NOX and SOX from the exhaust gases; this also requires more energy generation by the diesel power plant to handle the scrubber electrical loads. Now addressing the fine tuning of the sail set orientation relative to the apparent wind, this is accomplished through the mast assembly control system as explained in the following discussion. In FIG. 6 the strut 47 holding the canard winglet 50 on each aero foil 42 is fixed to the aero foil at an angle 108, of approximately 60 degrees, away from each sail arm 45 and 46 as shown. The canard winglet 50 can rotated by means of its servo 51 to rotate the winglet 50 relative to the support strut 47. When the canard winglet 50 is in the neutral position, and the aero foil is in its nominal configuration as shown in FIG. 6, the mast assembly assemblies are free to rotate in a weather vane motion to line up with the apparent wind, and while in this configuration the sail set 14 do not generate significant thrust. If the sails 14 are desired to generate thrust, the aero foil 42 is rotated by its servo 48 which causes it to rotate relative the mast assembly core 43 and the attached boom 33. When aero foil is rotated away from the nominal configuration, one of the sail set's leading foot edge 63 is moved forward of the other sail set's 62 leading foot edge relative to the apparent wind direction of the mast assembly assemblies under consideration. The imbalanced caused by this rotation causes the sail set 14 to generate thrust on the mast assembly core and thus on the space frame of the present invention. In this case the upstream sail of the sail set 14 is acting like the main sail of a typical sail boat and the downstream sail is acting like the jib of a typical sail boat—see FIG. 11 through FIG. 14. Fine tuning of the sail set relative to the apparent wind is accomplished via rotation of the canard winglet 50. When this winglet is rotated by its servo an imbalance in the wind load on the sail set caused by this rotation will rotate the aero foil and the associated mast assembly and the sail set will generate more or less thrust depending on the rotation direction of the canard winglet 50. Similarly the second mast assembly sail set can also be controlled by the identical mechanism on the mast assembly core of this mast assembly. This allows both mast assembly assemblies to have their respective mast assembly sail sets tuned independently though the above components of the mast assembly control system, which provides a means for said mast assemblies and sail set configurations to suit wind conditions, relative to the apparent wind for maximum effectiveness on all points of sail.

Now to addressing the folding sequence of the mast assemblies and the fore spar, when the mast assembly assemblies and the fore spar are to be folded down into the pre-deployed configuration, while the sailing space frame is not coupled to the vessel to be propelled, the following sequence is utilized.

First the aero foil 42 is rotated to the nominal orientation by its servo motor (this is the weather vane configuration shown in FIG. 6). In this nominal orientation the strut that supports the canard winglet and the boom are parallel, as shown in FIG. 6 (the weathervane configuration). Then the tension in the boom yang cable 36 is reduced as the two electric roller furler's 55 are activated to furl the sail set as shown in FIG. 8A. These two simultaneous actions result in the sail set 14 being furled and the booms 33 rotating up against the respective aero foils 42 into the pre deployed configuration as shown in FIG. 8A configuration 112 (where the top surface of the boom 33 is parallel to the cylindrical axis of the mast assembly core 58.

The outrigger hull 17 shown in FIG. 5 is used to correctly orient the space frame for the folding process this involves the use of the propulsion system on the outrigger hull 17. These outrigger thrusters are used to rotate and/or propel the outrigger hull 17 so as to point the sailing space frame into the wind, if there is any, to orient the outrigger hull 17 in a downwind position. Once in this position both the dagger and rudder assemblies are rotated so that the semi ring wing foils are perpendicular to the wind direction—to provide a drag force thus keeping the space frame 5 with the outrigger in downwind position. This assures that the wind will assist in rotating the mast assembly assemblies with furled sails so that the canard winglets are driven by aero drag directly downwind of the apparent wind and roughly pointing toward the solar dome.

The aforementioned sequence is then used to lock the mast assembly assemblies against rotation when they are in the appropriate configuration for finally lowering down into their saddles. At this point the mast assembly foot of each mast assembly is moved simultaneously via its trolley, back toward the solar dome. This actions result in the slow lowering of both the mast assemblies and the fore spar. This process continues until each mast assembly and the fore spar rests in their respective saddles on the space frame as shown in FIG. 3. The deployment sequence for the mast assemblies and the fore spar follow the reverse sequence of these actions when a full deployment is required, both for independent sailing of the space frame or after the space frame is coupled to the subject vessel.

Now addressing the rudder and dagger assembly structure and functions, the rudder assembly 70 and the dagger assembly 71, as shown in FIG. 2 are identical except for their name which indicates where these components are located on the space frame 5 relative to the vessel to be propelled. The dagger board hull is located close to the bow of the subject vessel vertex 3 in FIG. 2, and the rudder hull is located closer to the stern of the subject vessel, vertex 2 in FIG. 2. The rudder assembly will be described here, and this description also applies to the design of the dagger board hull assembly. The rudder assembly consists of a rudder support hull 18 and a semi-ring wing foil 19 as shown in FIG. 16. The rudder support hull has a circular deck and an inverted dome shaped displacement type hull structure. This circular hull configuration is needed to minimize the torque requirements to rotate this hull in going from the independent propulsion of the sailing space frame to the configuration when the sailing space frame is coupled to the cargo or tanker vessel. The rotation torque is provided by a servo (not shown) mounted on the vertical shaft around which this hull rotates. This rudder assembly is fixed to the space frame 5 via a central vertical shaft which passes through the central shaft housing 175, and the attached articulation structure components 87 and 88 connected to the central deck beam 122. A semi ring wing foil 74 is attached to the rudder hull and is capable of being lifted into the pre deployed configuration or lowered into the deployed configuration via an electric rotation/lock device (not shown). The respective central vertical shaft on both the rudder hull and the dagger board hull is used to electrically rotate these hulls through the respective servos (not shown) to the range of configurations 73 and 74 shown in FIG. 17, relative to the space frame 5, These rotations are required when the space frame is being sailed or propelled electrically-before, or after, the space frame is coupled to the cargo or tanker vessel. In the uncoupled mode the rotation of the outrigger hull 17, about its vertical shaft 90 in FIG. 17 can be used to steer the space frame under sail or electric propulsion.

Now addressing the operation of the vessel coupling system, this system incorporates the following components and provides the means for coupling a vessel to be propelled to the space frame of the current invention. First there is a coupling mechanism 135 on the space frame, this mechanism is used to connect the space frame to the cargo or tanker vessel to be propelled, and it has two major components, the first is the bridges 76 and 77, shown in a side view in FIG. 24, and an end view, as seen from the bow of the subject vessel, in FIG. 25. These bridges are fixed to the vessel to be propelled and serve as the interface between the vessel to be propelled and the space frame 5 of the present invention. These bridges are located on the gunwale rails 78 affixed to both sides of the vessel on the outside of the vessel hull, at deck level—see detail section in FIG. 26. These rails allow the two bridges 76 and 77 to be moved fore or aft on the subject vessel so that the cargo containers can be lifted up by the unloading crane or loaded into position in the vessel hull by the loading crane, without any interference by the presence of the two bridges. Similarly the move-ability of the bridges on a tanker is important so that they can be moved to facilitate loading or unloading their liquid cargo. The two bridges 76 and 77 are built to the proper length to suit the specific vessel beam width, but the sailing space frame can couple to the bridges on any vessel with its coupling mechanism 135. FIG. 29 is a top view of the coupling mechanism 135, and also shown in FIG. 30 in the uncoupled configuration to bridge and in FIG. 31 in the coupled configuration relative to the bridge 77. There are four coupling mechanisms 135 used to connect the space frame to the bridges 76 and 77, two for each bridge. The two coupling mechanisms 135 on the bridge 76, are mirror images of the coupling mechanisms 135 on the bridge 76, this is required so that the coupling mechanisms close in the direction of the bow of the vessel to be propelled for the bridge 77, and the coupling mechanisms close in the direction of the stern of the vessel to be propelled for the bridge 76. Now to address the operation of the coupling mechanism attached to the space frame which clamps onto these bridges in order to fasten the space frame to the vessel—see FIG. 31. Each clamping mechanism has a jaw 78 which under the action of a hydraulic cylinder 80 grasps the associated section of the bridge beam 79 as shown in FIG. 30.

The angular configuration 162 of the bridges as shown in FIG. 28, matches the angles between the two space frame deck beams 22 and 23. This allows the space frame to subject vessel coupling process to proceed smoothly as explained shortly.

When the space frame 5 is coupled to the subject vessel, the two mast assembly assemblies of the space frame (when fully deployed) are located directly above the center of the span between the gunwales of the cargo or tanker vessel This location minimizes any eccentricity in the loads that would be caused by the weight of the mast assembly assemblies on the vessel, except for downstream sailing, where the two mast assembly assemblies can be moved slightly away from this nominal location to insure that the sail sets of both mast assemblies see clean air.

When the space frame is approaching the cargo or tanker vessel, which should be on a course perpendicular to the long axis of the subject vessel, the hydraulic cylinders attached to the arms connecting the rudder and dagger assemblies are used press down on these two hulls in order to raise the two base triangle vertices 2 and 3 so that the each bridge coupling mechanism near both vertices 2 and 3 is higher than the two corresponding coupling bridges that are fastened to the hull gunwales of the cargo or tanker vessel.

When the space frame 5 is almost directly above the coupling points on the bridges, a set of wireless proximity probes (not shown) on the space frame 5 will triangulate on the corresponding coupling points on the bridges (not shown). Proximity information will be sent to the coupling program on the computer in the crews' quarters, and coupling software will control the elevation and lateral positions of the coupling points on the space frame relative to the corresponding points on the bridges. This will be accomplished by the hydraulic cylinder activation above the rudder and dagger board assembly hulls, and by the elevation of the space frame vertex 1 above the outrigger hull 17 and the finally by the electric propulsion of the outrigger hull 17. This will assure that the coupling process can interactively adapt to the rolling and pitching of the cargo or tanker vessel. The entire coupling process is shown in FIGS. 45, 46, 47, and 48. The space frame is moved past the exact location for coupling as shown in FIG. 47. At this point the space frame will be lowered onto the respective bridge extensions 81 as shown in FIGS. 29, 30 and 31. The top view of the outboard extension 83 of beam 77 as shown in FIG. 27, illustrates the vertical portion of the bridge 83 also serves to guide the space frame beams 22 and 23 into their final position. The beams 22 and 23 also incorporate vertical extensions 105, which stop against the bridge when the space frame is in the correct location for coupling. Once resting on the bridge extensions 81, the outrigger hull 17 will move the space frame 5 slightly away in direction 82 from the subject vessel as shown in 48 until the space frame is in the correct location laterally and vertically for the coupling jaws to be activated. At this point the space frame 5 locked via the jaws 78 on to the vessel to be propelled. The bridges incorporate guide posts 83 on their extremities as shown in FIGS. 24 and 27 to insure that the coupling process is successful, and these guide posts are helpful in adjustments during the lowering process that may not be fully compensated for by the computer control.

Once the space frame is coupled to the cargo or tanker vessel, the rudder and dagger assemblies are rotated into the configuration as shown in FIG. 49. As previously mentioned, the dagger assembly is identical to the rudder assembly except that it is located in the aft position on the space frame, when the space frame is coupled to the vessel to be propelled. Once the space frame 5 and vessel 111 have been coupled, the rudder and dagger assemblies provide two functions. First they are used to impede leeward drifting when the space frame and the coupled vessel are on a broad reach or tacking. The second function is to steer the space frame and the coupled vessel. In this latter mode both the rudder and dagger assemblies are rotated 84 by their respective servos on their central vertical shafts in opposite senses to make the steering process more efficient—see FIGS. 39, 40, 41, and 42. Also shown in these figures is the use of the thrusters in the direction 85 on the outrigger hull 17 to assist the change in direction of the subject vessel during tacking or turning maneuvers, when the velocity of the subject vessel is not adequate to make the turn under sail power alone.

As mentioned, in the coupling process the rudder and dagger board assemblies are used to lift the two vertices 2 and 3 of the triangular base of the space frame 5 by being pushed down by hydraulic or mechanical means 86 in FIGS. 15 and 16. In this configuration the displacement of the rudder and dagger board hulls is much greater because of the space frame load they are sustaining. Once the coupling is complete, the force exerted by the hydraulic rams, or other mechanical means, is stopped and the rudder and dagger board hulls are allowed to float freely in the vertical direction and their displacement just offsets the weight of their respective hulls and the semi ring wing foils. This feature minimizes the drag of these two hulls when the coupled space frame/vessel is under sail power. The semi ring wing foil configuration is utilized because it provides less drag than a typical blade type rudder or dagger board—because there are no blade tip vortices generated, as would be the case where a vertical dagger or rudder blade were used. In addition, the fact that it is fixed at either extremity to the respective rudder or dagger board hull increases the strength of the foil against leeward forces. Finally the semicircular configuration lowers the draft of the rudder and dagger board assemblies. The coordinated use of rotations both the rudder and dagger assemblies, improves the steer-ability of this space frame/vessel assembly.

Now turning to the multiple functions of the outrigger hull 17, the outrigger hull 17 has side plates 170 as shown in FIG. 32 on either side of its hull to provide some leeward resistance when the space frame is not coupled to a cargo ship or tanker vessel. FIG. 32 represents Section AA from FIG. 33. When coupled to the vessel to be propelled, the outrigger serves two purposes; first, it enables the coupled space frame 5 and the propelled vessel to utilize the large sail set area provided, secondly, it stabilizes the coupled vessel against rolling. It prevents the coupled vessel from rolling to the starboard when the wind load on the sail sets is coming from the port side of the vessel. The weight of the outrigger, the crew's quarters, and the solar dome, which are all located above the outrigger hull and also provide the weight necessary are used to offset wind loads on the sails from the starboard side. In addition the triangular base through its three point support, on the two bridges, and on the outrigger, provides the means for providing a single connection to outrigger, which in turn reduces the loads both on the vessel and the space frame. The outrigger can be located on the port side of the vessel and the same functions would be fulfilled as when it was located on the starboard side as described herein, and the wind loads on the sails from either the port of the starboard side would be offset by the outrigger to minimize rolling of the coupled vessel—due to waves or wind, and further more even when the sails are not deployed.

In order for the outrigger hull 17 to be rotated in the horizontal plane, it is rotated by the thrusters previously discussed. By activating the forward thrust of the electric propulsion on the outrigger the forward acceleration of the outrigger assists the space frame/vessel in coming about from an Atlantic Proa (with the apparent wind coming from the port side) configuration, to a Pacific Proa configuration, as shown in FIGS. 39, 40, 41, and 42. Similarly, in coming about from a Pacific Proa configuration to an Atlantic Proa configuration the electric propulsion system can be used to provide reverse thrust on the outrigger hull 17—retarding its forward motion and assisting in the coming about maneuver, as shown in FIGS. 39, 40, 41, and 42.

Now addressing propulsion and rotation system for the outrigger hull, the outrigger hull incorporates a thruster system which has two electric propulsion thrusters, which are located on thruster arms that pivot on hinges, which move these thrusters from inside the outrigger hull to down to below the water level on either side of the outrigger hull, see the range of motion 96 in FIG. 32. When these thrusters are housed inside the hull they are completely out of the water and they do not contribute to the hydrodynamic drag forces on the outrigger hull when the space frame 5 is coupled to the vessel to be propelled. When they are lowered into the water they are completely submerged in the water.

When the space frame is coupled to the subject vessel, it is important that the deck of the subject vessel is maintained in a horizontal configuration relative to rolling about the long axis of the vessel 176—when the coupled space frame/vessel is at rest on the ocean. Because the loading of the vessel is a variable, it is required that the elevation of the space frame vertex 1 under the solar dome and above the outrigger hull 17 be adjustable. The adjustment of the elevation of this vertex 1 can be accomplished by hydraulic or mechanical outrigger elevation means, as previously discussed. Mechanical means are preferable because once set they do not require continuous energy input to maintain the elevation. One such mechanical means is the use of a threaded shaft with two keyways in it, see FIG. 35.

The crew's quarters 21 are located beneath the solar dome 15 in FIG. 3. The solar dome is covered in solar cells whose electrical output is stored in the battery bank beneath the crew's quarters. This electric energy is used in part to provide the power to the controls for the sails and the rudder and dagger assemblies. In addition it is used to raise or lower the solar dome/crew's quarters and the space frame relative to the outrigger hull 17, and also to raise or lower the rudder and dagger assemblies during the coupling process. The crew is responsible for the navigation of the sailing space frame, when it is uncoupled from a vessel, as well as in the coupling and decoupling process relative to the propelled vessel. When the space frame is coupled to the vessel to be propelled, the crew of the space frame resides on the subject vessel and in assists in the navigation of the coupled space frame/vessel and the control of the space frame 5 and its mast, rudder and dagger assemblies.

The space frame 5 is used to mate with the vessel to be propelled by moving perpendicular to the long axis of the vessel to be propelled; with the mast assembly assemblies and the fore spar in the fully folded configuration—see sequence in FIGS. 45, 46, 47, and 48. At this point the space frame/vessel is now in the Proa configuration see FIG. 49.

Once the space frame is coupled to the subject vessel, the two mast assembly assemblies and the fore spar can be raised by sliding the fore spar 8 trolley along its rail and the mast assembly assemblies 6 and 7 trollies along their respective rails as show in the FIG. 2. The boom 33 on each of the two mast assembly assemblies is lowered into the final deployed configuration, via the unfurling of the sail set on each mast assembly. This occurs when the roller furling mechanism on the leading edge of each sail is released so that the sail can unfurl, as shown in FIG. 8. At this point the mast assembly assemblies are allowed to weather vane until a course has been decided upon, then the aero foil 42 (with its attached sail arms and the canard support strut and the canard winglet) is rotated relative to each mast assembly core and the attached boom in order to allow the sails to use the wind to generate the thrust in the desired sailing direction, as shown in FIGS. 6 and 9.

Typically the foot of each mast assembly sits above the middle of each bridge when sailing on close hauled on a tack, or a broad reach. If the vessel to be propelled must sail downwind, either of the mast assembly assemblies 6 or 7 can be moved back toward the outrigger hull 17, this allows clean air to be seen by both sails on each mast assembly for maximum downwind sailing speed—see FIG. 36. There is another important advantage of having the foot of each mast assembly capable of being moved along its respective rail and set in the desired location. This capability is required so that the drag force of the outrigger hull 17 and the drag force from the water due to the coupled vessel can be balanced by the location of the respective foot or each mast assembly, insuring that the resultant propulsive force generated by the sail sets acts at this balance point to avoid any undue turning torque on the coupled space frame/vessel. This is especially important when the vessel is being propelled in the down wind direction.

In order to accept the space frame and to limit the range required for lifting the space frame by the rudder and dagger board assemblies and the outrigger hull 17 to adapt to various container vessels, it might be required eliminate at least two lanes of containers, so that the bridge angles relative to the long axis of the vessel 176 could accommodated without interfering the containers and the bridges could still be close to the deck level. If the vessel to be propelled is carrying containers, some of these should be taken out to form the required open bridge lanes, and could be placed on top of other cargo containers, this should not cause a problem because the outrigger on the space frame 5 prevents rolling of the vessel, and the extra height of these moved containers should not significantly affect the potential listing of the vessel when the space frame is coupled to it. This approach reduces the range of elevation required for the space frame to match vessel hull heights, and thus simplifies the mechanisms and stresses involved in this elevation process. An alternate approach would be to configure beams 22 and 23 to be curved or bent, so that these beams would be perpendicular to long axis of the vessel to be propelled over the vessel deck area, while still maintaining the triangular deck 5 of the space frame configuration, between the starboard side of the vessel (as described and illustrated herein) to be propelled and the outrigger vertex 1. The bridges would have to be parallel to the aft and fore deck beams 22 and 23 over the deck area of the vessel to be propelled. In this manner beams over the deck connecting to the bridges would fit into the existing lanes between containers, and not require any movement of containers on the vessel to be propelled. An alternate space frame vessel coupling system for container ships, would involve incorporation the same type of coupling mechanism previously described, but these mechanisms would be required to mount onto the existing structure that also supports the containers (instead of the parallel bridges previously mentioned). This would also eliminate loss of container carrying ability, and still allow the coupling of the modified space frame with the bent fore and aft deck beams of the present invention to be utilized by these types of vessels. The suggested alternate approach using the bent fore and aft deck beam configuration of the triangular base of the space frame 5 would provide an alternate means for coupling to container ships, without the rearrangement of the containers to open up lanes for the bridges with the included angle 162 shown in FIG. 28.

During ocean voyages cargo ships would be under their own diesel power entering and exiting their port of call. Once a few miles off shore the vessel to be propelled would be coupled to the sailing space frame of the present invention. Then under pure sail power they would be transported over the long ocean voyage between ports on different continents. Once close to the destination port or ports, the vessel to be propelled would be decoupled from the space frame, and again under their own diesel power, maneuver into the port area and unload and reload their cargo.

The following steps are used in the decoupling process for the space frame 5 from the vessel being propelled. First stop the sail power propulsion of the vessel by putting the sail sets in the weathervane configuration. Second rotate the outrigger hull 17 so that it is perpendicular to the long axis of the vessel. Then disengage the jaws between the sailing space frame and the bridges on the vessel. Now the space frame vertices 2 and 3 can be lifted up vertically above the vessel via use of the hydraulic cylinders pressing the rudder and dagger assemblies down to a greater depth into the water, and elevating vertex 1 of the triangular base 5 of the space frame by driving the outrigger hull 17 down. Finally the outrigger can pull the sailing space frame away from the vessel to a safe distance using its thrusters, before the vessel is allowed to move under its own diesel power.

Throughout the description of the control and operation of the sailing space frame the use of electrical power and servo controls and mechanisms are mentioned. The use of power and control signals requires that these required electrical transmission currents pass through many interfaces between stationary components such as batteries and the rotating components of the present invention. This transmission is planned to be accomplished through the use of inductive coupling—this well know technology is not described nor illustrated herein for this reason.

There are a number of configuration changes used in the operation of the present invention both as an independent craft and when coupled to a vessel to be propelled. These configuration changes can be carried out manually by the crew of the present invention, or with the assistance of a computer control codes. There are a few configuration changes that would definitely be enhanced in efficiency by the use of a dedicated computer code, these are as follows:

1. Leveling of the deck of subject vessel relative to the rolling direction by adjusting the elevation of the outrigger vertex over the outrigger hull 17.
2. Coordinating the unfurling of the sails on each mast assembly using the roller furler operating in conjunction with the tension provided by the boom yang on the clews of each sail set and the lowering of the boom during this process.
3. Adjusting the rotation of the aero foil counter weight to suit desired orientation of the boom on each aero foil for different sailing configurations as well as for the folding process.
4. Coordinating the rotation of the rudder and dagger board hull assemblies to accomplish course changes when the space frame 5 is not coupled to the subject vessel, as well as during maneuvers when the space frame is coupled to the subject vessel.
5. Control of the twin thrusters on either side of the outrigger hull 17 to accomplish both forward and reverse thrust as well as to rotate the outrigger hull 17 around the outrigger connection shaft during coupling and decoupling maneuvers as well as for steering the outrigger hull 17 when the present invention is under way, independent of the vessel to be propelled.
6. Optimizing the rotation of the aero foils on each mast assembly as well as the canard winglet to assure the maximum thrust of each sail set as well as coordinating the relative thrust of each sail set on each mast assembly to insure the most efficient use of the sails thrust to move the coupled space frame/vessel for all courses relative to the apparent wind and desired sailing direction.
7. Coordinating the forward and reverse thrust of the twin thrusters on the outrigger hull during the coming about maneuver required during tacking for the coupled space frame/vessel.
8. Coordinating the coupling and uncoupling process for the space frame with the vessel to be propelled in order to minimize stresses and impacts on both the subject vessel bridges as well as on the present invention.

Further modifications of the invention herein disclosed will occur to persons skilled in the art and all such modifications are deemed to be within the scope of the invention as defined by the appended claims.

What is claimed is:

1. A sailing space frame adapted to sailing on water in a sailing direction and to be coupled to a vessel to be propelled, comprising:

a triangular base, a rudder assembly, a dagger assembly, an outrigger, at least two mast assemblies, a fore spar, a crew's quarters, a solar dome, and a vessel coupling system for the vessel to be propelled;

wherein said triangular base comprises a fore deck beam, an aft deck beam, and a central deck beam which connect the vessel to be propelled to said outrigger, said at least two mast assemblies, said fore spar, and said crew's quarters;

wherein each of said at least two mast assemblies comprises a mast core attached to a boom base, a boom, and a counterweight, said mast core having a cylindrical axis;

wherein each of said counterweights is pivotable about said cylindrical axis to orient each mast core about said cylindrical axis;

wherein said rudder assembly and said dagger assembly each comprise a rudder hull, a semi ring wing foil, and a central vertical shaft;

wherein said rudder assembly is connected to said central deck beam through a rudder assembly support structure, and said dagger assembly is connected to said central deck beam through a dagger assembly support structure, said rudder assembly support structure and said dagger assembly support structure both connected to said central deck beam;

wherein said outrigger is attached to said triangular base by an outrigger connection shaft at an outrigger vertex of said triangular base, said outrigger connection shaft in communication with a motor for elevating said triangular base above said outrigger, said outrigger further comprising a regenerative braking system to generate electricity;

whereby said outrigger vertex is connected to said crew's quarters, said solar dome placed on a roof of said crew's quarters;

wherein each of said at least two mast assemblies further comprises an aero foil, said aero foil connected to two sail arms for a sail set, said sail arms holding cables attached to roller furling devices for unfurling and furling said sail set, said aero foil further connected to a strut connected to a canard winglet;

wherein each counterweight of said at least two mast core assemblies further comprises a counterweight servo to balance each mast assembly relative to said cylindrical axis and to orient said aero foil relative to said cylindrical axis;

whereby said sailing space frame may propel said vessel to be propelled without use of fossil fuels, reduces listing due to wind land wave loads, increases vessel leeward resistance, and improves directional control for the vessel to be propelled.

2. The sailing space frame adapted to sailing on water in a sailing direction as claimed in claim 1, wherein, said fore deck beam, said central deck beam, and said aft deck beam of said triangular base join at said outrigger vertex, where each of said fore deck beam, said central deck beam, and said aft deck beam each have a rail mounted on a top surface, each of said rails connected to said at least two mast assemblies and said fore spar, vessel coupling system comprises at least one jaw configured to grasp a corresponding bridge mounted on the vessel to be propelled, wherein said triangular base of said sailing space frame provides a single connection to said outrigger through said outrigger connection shaft, reduces stress induced in said sailing space frame, and reduces stress in said vessel to be propelled.

3. The sailing space frame adapted to sailing on water in a sailing direction as claimed in claim 1, wherein said rudder assembly and said dagger assembly further comprise a central shaft housing for said central vertical shafts and a hydraulic cylinder, whereby, said hydraulic cylinder is configured to elevate said triangular base of said sailing space frame, whereby, said semi ring wing foils on said rudder assembly and said dagger assembly are configured to improve leeward resistance and directional control of the sailing space frame and the vessel to be propelled, wherein, the sailing space frame and vessel to be propelled are coupled in a viable sailing configuration.

4. The sailing space frame adapted to sailing on water in a sailing direction as claimed in claim 1, wherein, said outrigger is connected to said outrigger vertex of said triangular base through said outrigger connection shaft, which in turn is connected to a horizontal shaft which is connected to an outrigger hull, whereby said outrigger hull houses a thruster on each side of said outrigger hull, where each thruster is connected to a thruster arm, whereby said thrusters are configured to propel and steer said sailing space frame, wherein electric energy generated by said outrigger is used for controlling said sailing space frame, propelling said sailing space frame when not under sail, and for assistance for tacking when said sailing space frame is coupled to said vessel to be propelled.

5. The sailing space frame adapted to sailing on water in a sailing direction as claimed in claim 1, wherein, each aero foil of said at least two mast assemblies surrounds said mast core, wherein said aero foil is connected to a canard winglet support strut, a canard winglet rotation servo, an aero foil rotation gear, an aero foil rotation servo, and an upper swivel coupling said roller furling devices to said aero foil, wherein said counterweight is attached to said aero foil and said counterweight servo comprising a ring gear on said counterweight in communication with a pinion gear and a solenoid on said triangular base, said counterweight servo configured to adjust said sail set to suit wind conditions;

whereby said at least two mast assemblies are configured to weathervane when said sailing space frame is not under way, and reduce energy required to adjust said at least two mast assemblies and said sail sets.

6. The sailing space frame adapted to sailing on water in a sailing direction as claimed in claim 1, wherein said vessel coupling system comprises at least one jaw on said fore deck beam and at least one jaw on said aft deck beam, said jaws configured to be coupled to corresponding bridges on said vessel to be propelled, whereby said vessel coupling system is adjustable so as to accommodate vessels of different beam widths.

7. The sailing space frame adapted to sailing on water in a sailing direction as claimed in claim 1, wherein said fore spar, is connected to a trolley translation mechanism mounted on a fore spar trolley connected to said rail or an elevated section of said rail on said central deck beam, and said fore spar is further connected to each mast assembly, allowing said sailing space frame and said mast assemblies to convert from a pre-deployed to deployed configuration.

8. The sailing space frame adapted to sailing on water in a sailing direction as claimed in claim 1, wherein said vessel to be propelled further comprises a plurality of containers, wherein said fore and said aft deck beams are curved or bent so that said fore and said aft deck beams are perpendicular to a long axis of said vessel to be propelled, said curved or bent fore and said aft deck beams allowing coupling and propulsion by said sailing space frame without a loss of container capacity on said vessel to be propelled or required re-arrangement of containers.

* * * * *